US006192207B1

(12) United States Patent
Yamamoto et al.

(10) Patent No.: US 6,192,207 B1
(45) **Date of Patent: *Feb. 20, 2001**

(54) IMAGE FORMING APPARATUS PROVIDED WITH A PLURALITY OF IMAGE HOLDING COMPONENTS

(75) Inventors: Koji Yamamoto, Aichi-Ken; Tetsuya Onuki, Toyokawa, both of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/082,011

(22) Filed: May 20, 1998

(30) Foreign Application Priority Data

| | | |
|---|---|---|
| May 21, 1997 | (JP) | 9-146064 |
| Sep. 17, 1997 | (JP) | 9-251809 |
| Sep. 17, 1997 | (JP) | 9-251810 |
| Apr. 22, 1998 | (JP) | 10-112273 |

(51) Int. Cl.[7] ..... G03G 15/00; G03G 15/16

(52) U.S. Cl. ..... 399/82; 399/299; 399/303; 399/316

(58) Field of Search ..... 399/66, 107, 298, 399/299, 312, 313, 316, 317, 345, 344, 71, 82

(56) References Cited

U.S. PATENT DOCUMENTS

| | | | | |
|---|---|---|---|---|
| 5,521,691 | * | 5/1996 | Morimoto et al. | 399/345 X |
| 5,765,082 | * | 6/1998 | Numazu et al. | 399/299 |
| 5,893,017 | * | 4/1999 | Yamamoto | 399/299 |
| 6,029,023 | * | 2/2000 | Munemori et al. | 399/66 |

FOREIGN PATENT DOCUMENTS

| | | | |
|---|---|---|---|
| 3-288173 | * | 12/1991 | (JP) . |
| 4-341873 | * | 11/1992 | (JP) . |
| 8-022198 | * | 1/1996 | (JP) . |
| 9-146383 | * | 6/1997 | (JP) . |
| 9-274354 | * | 10/1997 | (JP) . |

* cited by examiner

*Primary Examiner*—Sophia S. Chen
(74) *Attorney, Agent, or Firm*—Morrison & Foerster LLP

(57) ABSTRACT

An image forming apparatus is provided with a plurality of image forming units along a transportation path of a recording sheet transported by a revolving transport belt, each image forming unit including an image holding component. The image forming apparatus is further provided with a transport belt moving unit for moving the transport belt between a first state and a second state by changing a form of a revolution of the transport belt, the first state being where the transport belt does not touch at least one of the image holding components and the second state being where the transport belt touches the image holding components not touched in the first state.

27 Claims, 30 Drawing Sheets

Fig. 23

1060

| | | 48K | 48Y | 48M | 48C |
|---|---|---|---|---|---|
| FROM OPERATION PANEL | FULL-COLOR MODE KEY | ○ | ○ | ○ | ○ |
| | YELLOW SPECIFY KEY | × | ○ | × | × |
| | MAGENTA SPECIFY KEY | × | × | ○ | × |
| | CYAN SPECIFY KEY | × | × | × | ○ |
| | BLACK SPECIFY KEY | ○ | × | × | × |
| | RED SPECIFY KEY | × | ○ | ○ | × |
| | GREEN SPECIFY KEY | × | ○ | × | ○ |
| | BLUE SPECIFY KEY | × | × | ○ | ○ |
| FROM DOCUMENT JUDGING UNIT | FULL-COLOR DOCUMENT | ○ | ○ | ○ | ○ |
| | MONOCHROME DOCUMENT | ○ | × | × | × |

○…USED, ×…NOT USED

IMAGE FORMING APPARATUS PROVIDED WITH A PLURALITY OF IMAGE HOLDING COMPONENTS

This application is based on applications Nos. 9-146064, 9-251809, 9-251810, and 10-112273 filed in Japan, the contents of which are hereby incorporated by reference.

BACKGROUND OF THE INVENTION (1) Field of the Invention

The present invention relates to a so-called "tandem-type" image forming apparatus where a plurality of image holding components, such as photosensitive drums, are set along the transportation path of a recording sheet.

(2) Related Art

Tandem-type image forming apparatuses have received much attention in recent years because of their ability to perform color printing at high speed.

A color copying machine, as one example of this type of image forming apparatus, has four photosensitive drums corresponding to four colors set along the transportation path of a recording sheet and a transfer unit. The transfer unit is set under the photosensitive drums and includes a transport belt that runs over a plurality of rollers and transfer chargers respectively facing the photosensitive drums. Toner images of cyan, magenta, yellow, and black separately formed on the photosensitive drums are sequentially transferred by the transfer chargers onto a recording sheet transported by the transport belt. As a result, four color images are superimposed on the recording sheet to form a color image. In general, the photosensitive drum used for forming a black image is set at a rearmost position on the transportation path of the recording sheet for better reproduction of black parts of the color image.

When performing operations aside from full-color image formation, such as when forming a black image formation using this type of image forming apparatus, toner images are not formed on the photosensitive drums for cyan, magenta, and yellow, and a toner image is formed only on the photosensitive drum used for the black image formation.

However, when only one photosensitive drum is used, the recording sheet still comes into contact with the other three photosensitive drums during transportation. For this reason, the three photosensitive drums which are not used for the image formation still need to be rotated. This results in unnecessary wear and tear on the photosensitive drums and cleaning blades that are in contact with the photosensitive drums. Against this backdrop, Japanese Laid-Open Patent Application No. 3-288173 teaches an example of a color image forming apparatus which tilts the whole transfer unit from the horizontal position when black image formation is performed, so that the transport belt does not come into contact with the photosensitive drums for C, M, and Y which are not used for black image formation.

Accordingly, the photosensitive drums of cyan, magenta, and yellow do not need to be rotated when a black image is formed. This prevents unnecessary wear and tear on these photosensitive drums.

Japanese Laid-Open Patent Application No. 3-288173 also teaches that a backup plate may be provided in the transfer unit for each photosensitive drum to improve the transfer of the toner images formed on the photosensitive drums. Each backup plate is an elastic member which presses the transport belt against the photosensitive drum immediately before a transfer position, so that the recording sheet transported by the transport belt is tightly pressed against the surface of the photosensitive drum before the recording sheet enters a transfer area. As a result, each toner image is reliably transferred onto the recording sheet.

With this conventional image forming apparatus, however, the transport belt is separated from the photosensitive drums by the shift of the whole transfer unit which is provided with the transfer chargers. This causes variations in the positions of the transfer chargers relative to the photosensitive drums during the image formation. As a result, image transfer is unstable.

Moreover, with this conventional image forming apparatus, the backup plates of the photosensitive drums of cyan, magenta, and yellow still push up the transport belt when forming a black image. This prevents the transport belt from running smoothly, and accordingly, a satisfactory transferred image cannot be obtained.

In addition, the position at which the photosensitive drum used for black image formation comes into contact with the transport belt, that is, the transfer position, is different when forming a black image than when forming a full-color image. As a result, image transfer is unstable.

SUMMARY OF THE INVENTION

The first object of the present invention is to provide an image forming apparatus which can prevent unnecessary wear and tear of the photosensitive drums and the like without shifting the whole transfer unit.

The second object of the present invention is to provide an image forming apparatus provided with components, such as backup plates, by which a satisfactory transferred image can be obtained even when a single-color image formation is performed.

The third object of the present invention is to provide an image forming apparatus by which the transfer positions of the image holding components used for an image formation do not vary regardless of whether the full-color image formation is performed.

The fourth object of the present invention is to provide an image forming apparatus by which a recording sheet transported to the transport belt is always received with stability even when the part where the recording sheet is received is changed due to the separation of the transport belt.

The first object can be achieved by an image forming apparatus made up of: a transport belt that revolves to transport a recording sheet; a plurality of image forming units which are set along a transportation path of the recording sheet and each include an image holding component; a transport belt moving unit for moving the transport belt between a first state and a second state by changing a form of a revolution of the transport belt, the first state being where the transport belt does not touch at least one of the image holding components and the second state being where the transport belt touches the image holding components not touched in the first state, and also can be achieved by an image forming apparatus including the transportation unit which is a loop-shaped belt.

The second object can be achieved by an image forming apparatus made up of: a transport belt for transporting a recording sheet; a plurality of image forming units which are set along a transportation path of the recording sheet and each include an image holding component; a plurality of members, each member being provided positionally opposite a different one of the image holding components, with the transport belt running between the plurality of members and the image holding components; and a member moving unit for moving a member selectively between a first position where the moved member presses the transport belt against the positionally opposite image holding component and a second position where the moved member is not in contact with the transport belt.

The third object can be achieved by an image forming apparatus which selectively operates in one of a full-color mode and a reduced-color mode, the full-color mode being where an image for a different color is formed on each image holding component and the formed images on the image holding components are successively transferred onto the recording sheet transported by the transportation unit, and the reduced-color mode being where an image is formed on at least one but not all of the image holding components and the formed images are transferred onto the recording sheet transported by the transportation unit, the image forming apparatus being made up of: a separating unit for separating the transportation unit from at least one image holding component that does not have an image formed thereon when the image forming apparatus is operating in the reduced-color mode; and a maintaining unit for maintaining a transportation path of the recording sheet relative to each image holding component used for an image formation regardless of whether an image formation is performed in the full-color mode or the reduced-color mode. The third object can also be achieved by an image forming apparatus which is capable of switching between a full-color mode and a monochrome mode, the image forming apparatus being made up of: a black image forming unit, including an image holding component, for forming a black toner image on the image holding component; a plurality of color image forming units, each including an image holding component; a transport belt for transporting a recording sheet to have the recording sheet pass under all the image holding components; a separating unit for separating the transport belt from the plurality of image holding components of the color image forming unit when an image formation is performed in the monochrome mode; and a running path maintaining unit for maintaining a running path of the transport belt in proximity to the image holding component of the black image forming unit, regardless of whether the image formation is performed in the monochrome mode or in the full-color mode.

The fourth object can be achieved by an image forming apparatus made up of: a sheet feeding unit for feeding a recording sheet; a transportation unit for transporting the recording sheet; a plurality of image forming units which are set along a transportation path of the recording sheet and each include an image holding component; a separating unit for moving the transportation unit away from at least one of the image holding components; and a guiding unit which shifts in accordance with movement of the transportation unit by the separating unit and guides the recording sheet fed by the sheet feeding unit to the transportation unit.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 23 shows a table which is stored in a ROM of the control unit;

DESCRIPTION OF PREFERRED EMBODIMENTS

First Embodiment

The following is a description of an embodiment of the image forming apparatus of the present invention. In this embodiment, a digital full-color copying machine is used as an example of such an image forming apparatus.

Figure 1:
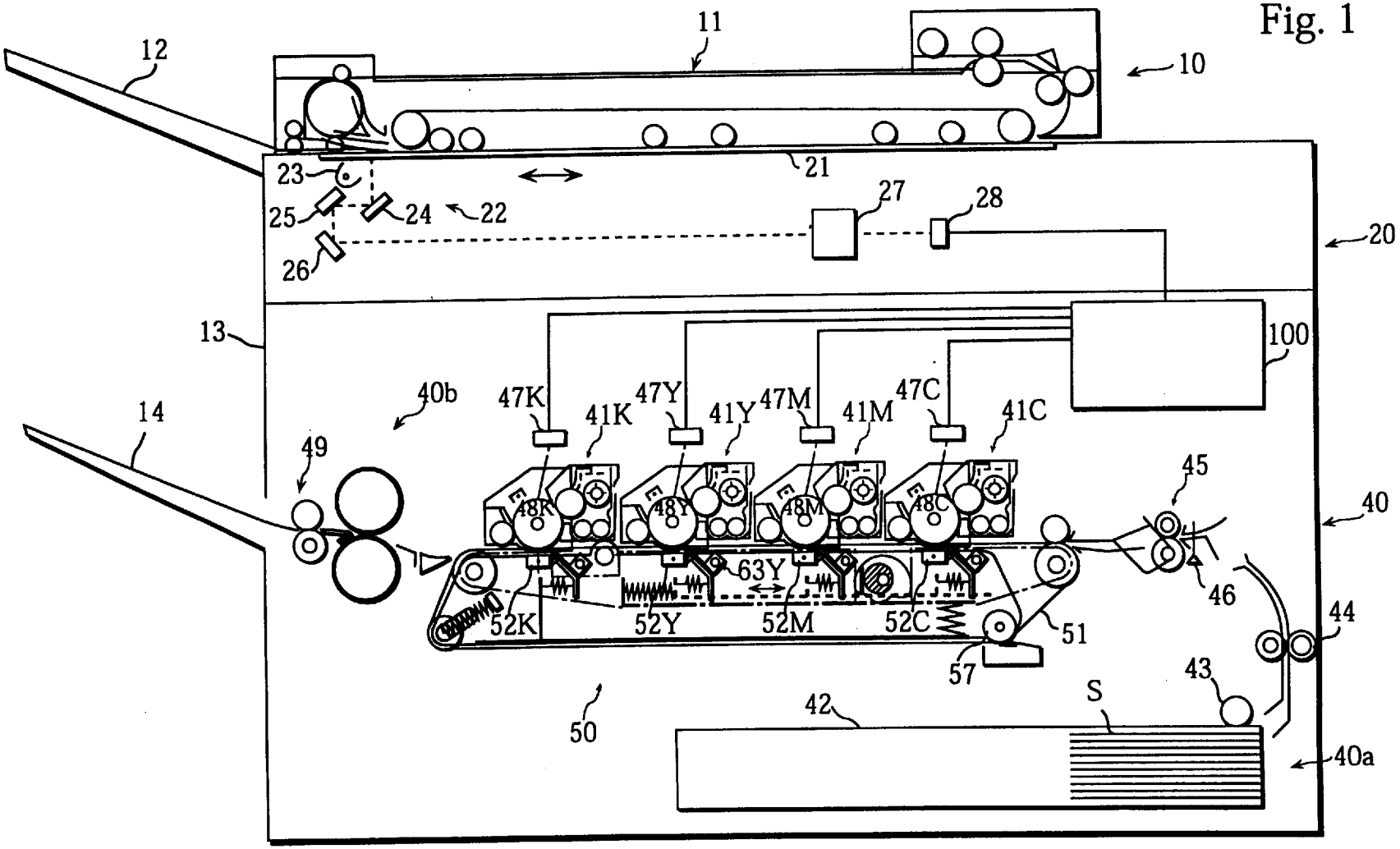
FIG. 1 shows the overall construction of a digital full-color copying machine of the first embodiment.

FIG. 1 is a front view of this digital full-color copying machine (simply referred to as the "copier" hereinafter).

As shown in FIG. 1, this copier is composed of an automatic document transport device 10, an image read unit 20, and a print unit 40.

The automatic document transport device 10 is a well known device which automatically transports documents set on a document feeding tray 11 to a platen glass 21 of the image read unit 20 one at a time, and which discharges each document onto a document discharge tray 12 after the document image has been read.

The image read unit 20 is provided with scanner 22 under the platen glass 21 that moves laterally, as shown by the arrow in FIG. 1. Light from the exposure lamp 23 of the scanner 22 is reflected by the document, and is redirected by mirrors 24–26 before passing through the converging lens 27 and into a CCD color image sensor 28. The CCD color image sensor 28 converts the reflected light into image signals of red (R), green (G), and blue (B), and outputs the image signals to a control unit 100.

The print unit 40 can be roughly divided into a paper supplying device 40*a*, a transfer unit 50, image forming units 41C to 41K, and a fixing unit 40*b*.

A paper supplying cassette 42 of the paper supplying device 40*a* is set in a lower space of an enclosure 13 and is slidable outward parallel to the viewing direction of FIG. 1. A recording sheet S supplied from the paper supplying cassette 42 by a paper supplying roller 43 is transported upward by a pair of intermediate rollers 44. The recording sheet S then activates a timing sensor 46 positioned immediately before a pair of synchronizing rollers 45 and stops with its leading edge touching the pair of synchronizing rollers 45 that are currently at rest. After standing by in this way, the recording sheet S is transported toward the transfer unit 50 by the pair of transfer rollers 45 that are rotated in synchronization with the image forming operations of the image forming units 41C to 41K. It should be noted here that the pair of synchronizing rollers 45 is driven by a motor (not illustrated), and that the rotation is started and stopped in accordance with ON/OFF of a timing clutch (not illustrated) which is set between the pair of synchronizing rollers 45 and the motor.

The recording sheet S is hereafter transported by a transport belt 51 of the transfer unit 50.

The image forming units 41C to 41K are placed in a line along the transport belt 51. The control unit 100 performs necessary image processing on the R, G, and B electric signals inputted into the control unit 100 and converts the signals into cyan (C), magenta (M), yellow (Y), and black (K) color elements. Laser diodes (not illustrated) of exposure units 47C to 47K set above the image forming units 41C to 41K are driven to perform light modulation based on the color signals. The light-modulated laser beams are respectively brought to the corresponding image forming units 41C to 41K. Each of the image forming units 41C to 41K is provided with a corresponding one of photosensitive drums 48C to 48K as a main component, a transfer charger, a developing unit, and a cleaning blade. The image forming units 41C to 41K are constructed to form images according to what is called an electrostatic copying method. More specifically, the image forming units 41C to 41K expose the surfaces of the photosensitive drums by the light-modulated laser beams and form electrostatic latent images, which are then developed by the developing units using toner. Note that C, M, Y, and K toner corresponding to the light-modulated colors of the exposure units 47C to 47K is supplied to the corresponding photosensitive drums 48C to 48K by the developing units of the image forming units 41C to 41K.

The toner images formed on the photosensitive drums 48C to 48K are sequentially transferred onto the recording sheet S transported by the transport belt 51 at respective transfer positions located under the photosensitive drums 48C to 48K using electrostatic power of transfer chargers 52C to 52K which are set on the underside of the transport belt 51. The recording sheet S on which a toner image is transferred is transported by the transport belt 51 to the fixing unit 40*b*, where toner particles on the surface of the recording sheet S are fused and fixed in place. The recording sheet S is then discharged onto a tray 14 via a pair of discharge rollers 49.

Next, the construction of the transfer unit 50 is described, with reference to FIG. 2 to FIG. 5.

Figure 2:
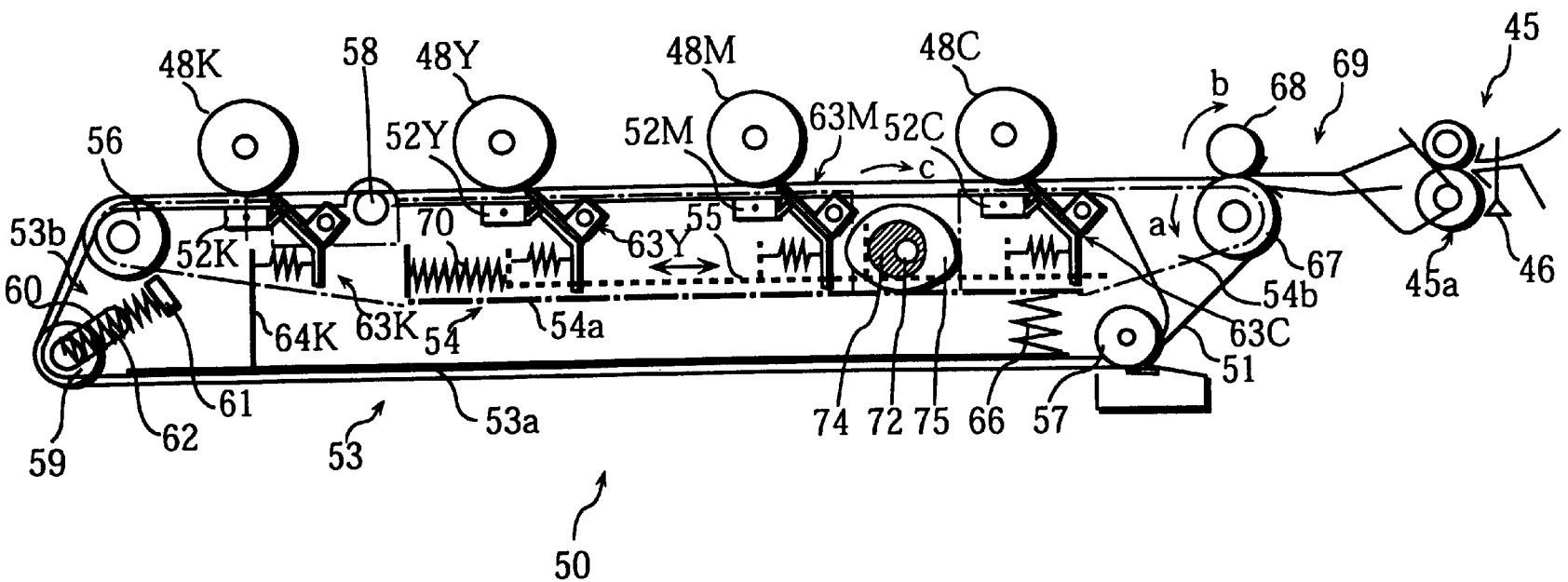
FIG. 2 is an enlarged view of the construction of a transfer unit of the digital full-color copying machine in the full-color mode.

FIG. 2 shows a front view of the transfer unit 50. The transfer unit 50 is composed of a main frame 53, a shift frame 54, and a slide frame 55. In FIG. 2, the main frame 53 is indicated by a solid line, the shift frame 54 by a dot-dash line, and the slide frame 55 by a dotted line.

The main frame 53 is formed of a base plate 53*a* that has a predetermined width (parallel to the viewing direction in FIG. 2) and side plates 53*b* that are provided on the front side and the rear side of the base plate 53*a* (as the copier is viewed in FIG. 2). Rotation axes of slave rollers 56 and 57, an assistance roller 58, and a tension roller 59 are set to freely rotate at the positions on the side plates 53*b* shown in FIG. 2 via respective bearings (not illustrated). The bearings of the tension roller 59 are held in rounded rectangular holes 60 which longitudinally extend upward and to the right, with the axis of the tension roller 59 passing through the holes 60. The bearings are held by the tension of compression springs 62 which are set between the bearings and spring mounting elements 61 that are set on the side plate 53*b* and protrude outward. The tension roller 59 keeps the tension of the transport belt 51 constant. The transfer charger 52K is set directly under the photosensitive drum 48K, with both ends of the transfer charger 52K being held by the side plates 53*b*. A transfer backup 63K is set on the right (as the copier is viewed in FIG. 2) of the transfer charger 52K.

Figure 3:
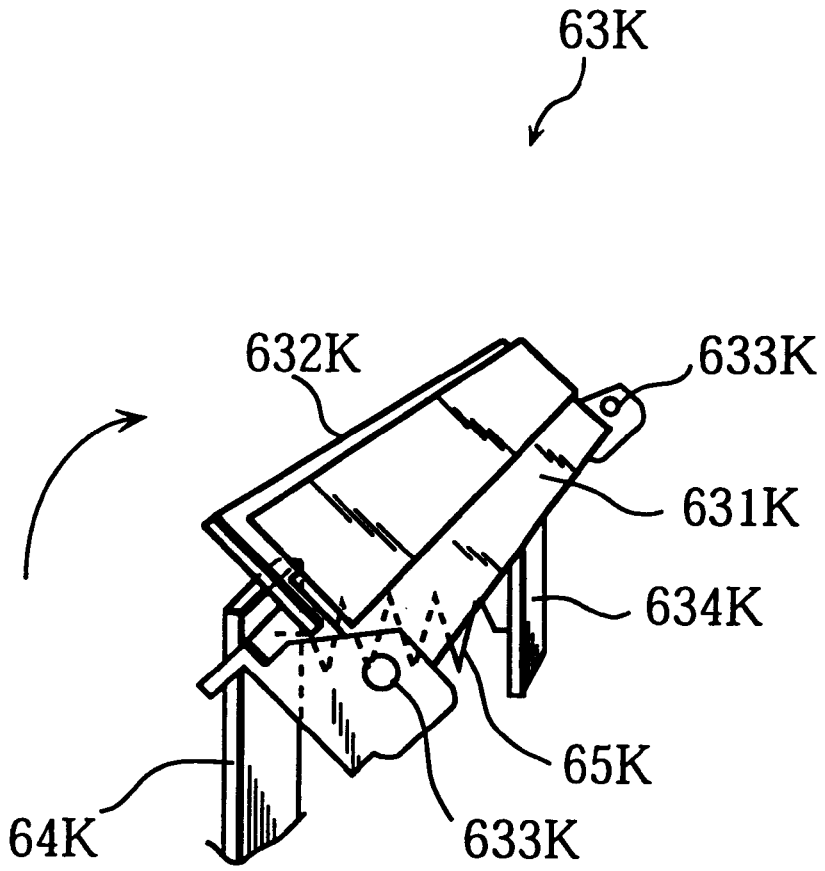
FIG. 3 is a perspective view of a transfer backup of the transfer unit.

As shown in FIG. 3, the transfer backup 63K is composed of a backup blade supporting member 631K and a backup blade 632K which is made up of polyethylene terephthalate (PET). This transfer backup 63K is mounted onto the main frame 53 by inserting backup mounting shafts (not illustrated) that protrude inward from both side plates 53*b* into mounting holes 633K provided at both ends of the backup plate supporting member 631K. A tensile spring 65K is mounted between a spring mounting component 64K set on the main frame 53 and a spring mounting unit 634K of the backup blade supporting member 631K. A rotational force is applied to the transfer backup 63K by the tension of the tensile spring 65K in the direction indicated by the arrow in FIG. 3, with the backup mounting axis as the center of rotation. As a result, the edge of the backup blade 632K presses the transport belt 51 (shown in FIG. 2) from underneath. The transfer backup 63K presses the transport belt 51 from underneath, so that a contact area of the transport belt 51 and the photosensitive drum 48K is enlarged. Consequently, a nip width of the recording sheet S transported on the transport belt 51 and the photosensitive drum 48K is ensured, and an excellent transfer of a toner image is performed by keeping the recording sheet S and the photosensitive drum 48K in absolute contact with one another as the recording sheet S enters the electrostatic transfer area. The nip width referred to here means the length of the circumference of the photosensitive drum which is in contact with the recording sheet.

In FIG. 2, the shift frame 54 is formed of an L-shaped base plate 54*a* and side plates 54*b* on the front side and the rear side of the base plate 54*a* (as the copier is viewed in FIG. 2). The shift frame 54 is set between the side plates 53*b* of the main frame 53, with the left ends (as viewed in FIG. 2) of the side plates 54*b* being mounted on the rotation axis of the slave roller 56 via bearings (not illustrated), so that the shift frame 54 may rotate. A compression spring 66 is set between the backside of the base plate 54*a* of the shift frame 54 and the upperside of the base plate 53*a* of the main frame 53. A drive roller 67 is set on the right corners (as viewed in FIG. 2) of the side plates 54*b* of the shift frame 54, with its rotation axis being held via bearings (not illustrated). An output axis of a motor (not illustrated) fixed to one of the side plates 54*b* is coupled to the rotation A axis of the drive roller 67, so that the drive roller 67 rotates in the direction indicated by the arrow a in FIG. 2. A charging roller 68 for pressing the surface of the drive roller 67 rotates in the direction indicated by an arrow b in FIG. 2 in synchronization with the rotation of the drive roller 67, with the transport belt 51 passing between these rollers. In addition, the charging roller 68 serves as a charger which charges the recording sheet S fed by the pair of synchronizing rollers 45, so that the recording sheet S is securely attracted to the transport belt 51. It should be noted here that a separating charger (not illustrated) is set on the left (as viewed in FIG. 2) of the photosensitive drum 48K. By means of this separating charger, the recording sheet S with the transferred toner images is separated from the transport belt 51.

A shift guide 69 is suspended between the pair of synchronizing rollers 45 and the drive roller 67. Via respective mounting components (not illustrated), one end of the shift guide 69 is mounted on the rotation axis of the lower roller 45*a* of the pair of synchronizing rollers 45 to freely rotate and another end of the shift guide 69 is held against the upper surface of the rotation axis of the drive roller 67 to freely slide. As such, the shift guide 69 will be shifted in accordance with the vertical movement of the drive roller 67 that occurs when the shift frame 54 is shifted. Consequently, the recording sheet S fed by the pair of synchronizing rollers 45 is reliably guided to the charging roller 68 via the shift guide 69.

The transfer chargers 52C to 52Y, which are held between the side plates 54*b* of the shift frame 54, come directly under the corresponding photosensitive drums 48C to 48Y when the shift frame 54 takes the uppermost position, i.e., in a full-color mode (as described later in this specification). The transfer backups 63C to 63Y are respectively mounted on the right (as viewed in FIG. 2) of the transfer chargers 52C to 52Y. The mounting states and constructions of the transfer chargers 52C to 52Y and the transfer backups 63C to 63Y are the same as those of the transfer charger 52K and the transfer backup 63K, and so will not be explained.

Figure 4:
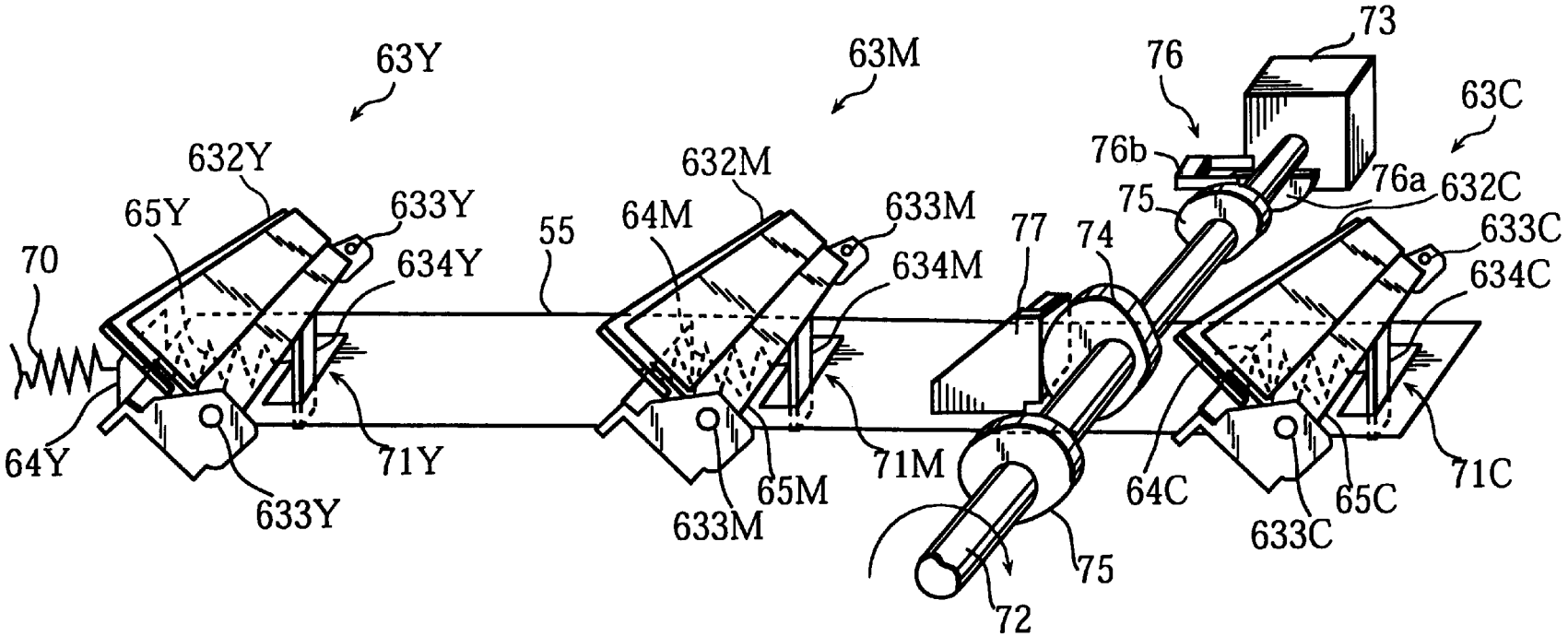
FIG. 4 is a perspective view of part of the transfer unit.

The slide frame 55 is set above the base plate 54*a* via a guiding component (not illustrated) between the side plates 54*b* of the shift frame 54, and is mounted to freely slide in a longitudinal direction. A compression spring 70 is set between the left side (as viewed in FIG. 2) of the slide frame 55 and the left side (as viewed in FIG. 2) of the base plate 54*a* of the shift frame 54. As shown in FIG. 4, spring mounting components 64C to 64Y corresponding to the transfer backups 63C to 63Y are provided for the slide frame 55. Tensile springs 65C to 65Y are mounted between the spring mounting components 64C to 64Y and corresponding spring mounting units 634C to 634Y of the transfer backups 63C to 63Y. The slide frame 55 is further provided with rectangular holes 71C to 71Y into which the lower parts of the spring mounting units 634C to 634K of the transfer backups 63C to 63Y are inserted. When the slide frame 55 slides to the right (as the copier is viewed in FIG. 2), the left side walls of the rectangle holes 71C to 71Y press the spring mounting units 634C to 634Y to the right, and as a result, the transfer backups 63C to 63Y turn counterclockwise. When the spring mounting units 634C to 634Y and the walls of the rectangle holes 71C to 71Y are not in contact as shown in FIG. 4, the spring mounting units 634C to 634Y are pulled toward the left by the tension of the tensile springs 65C to 65Y, and accordingly, the transfer backups 63C to 63Y turn clockwise to touch the transport belt 51.

A cam shaft 72 is mounted on the side plates 53*b* of the main frame 53 shown in FIG. 2 via bearings (not illustrated) to freely rotate, with one end of the cam shaft 72 being coupled to an output axis of a cam driving motor 73 which is, for example, a DC (Direct Current) motor. The cam shaft 72 is provided with a slide cam 74 for sliding the slide frame 55, a pair of shift cams 75 for shifting the shift frame 54, and a detection plate 76*a* for detecting a rotation position of the cams.

The slide cam 74 always contacts with a cam follower 77 set on the slide frame 55 which is pushed toward the right by the tension of the compressed spring 70. By rotating the slide cam 74, the slide frame 55 can be slid sideways by a distance equal to the difference between the widest and the narrowest parts of the slide cam 74.

The shift cams 75 are always in contact with the upper surface of the base plate 54*a* of the shift frame 54 which is pushed upward by the tension of the compressed spring 66 shown in FIG. 2. By rotating the shift cams 75, the shift frame 54 can be shifted upward and downward by a distance equal to the difference between the widest and the narrowest parts of the shift cams 75.

The detection plate 76*a* is made up of a semicircular plate. A photo sensor 76*b* is composed of a light-emitting element and a light-detecting element which face each other and are set on opposite sides of the detection plate 76*a*. The detection plate 76*a* and the photo sensor 76*b* comprise a rotation position detection unit 76. If the detection plate 76*a* is located between the light-emitting element and the light-detecting element, the photo sensor 76*b* outputs an OFF signal, or if not, the photo sensor 76*b* outputs an ON signal. This is to say, every time the detection plate 76*a* rotates 180 degrees, the signal outputted from the photo sensor 76*b* changes from ON to OFF, or alternatively, from OFF to ON. In accordance with this detection result, the rotation position of the cam shaft 72 provided with the detection plate 76*a* can be controlled for every 180-degree rotation. By means of the detection plate 76*a*, an output signal of the photo sensor 76*b* changes from OFF to ON when the widest parts of the shift cams 75 are located at the lowermost position, and changes from ON to OFF when the widest parts of the shift cams 75 are located at the uppermost position. Here, the shift cams 75 rotate in the direction indicated by the arrow in FIG. 4 together with the rotation of the cam shaft 72.

The rotation control of the cam driving motor 73 which rotates the cam shaft 72 provided with these cams is performed by the control unit 100. The control unit 100 detects the rotation positions of the shift cams 75 using the photo sensor 76*b* and activates/stops the cam driving motor 73 to have the shift frame 54 stop at the uppermost position or the lowermost position.

As shown in FIG. 4, the widest parts of the shift cams 75 and the widest part of the slide cam 74 are out of phase with each other by 90 degrees. As such, when the widest parts of the shift cams 75 are located at the uppermost positions (i.e., the narrowest parts are located at the lowermost positions) and the shift frame 54 is at the uppermost position, the widest part of the slide cam 74 is located at the left (i.e., the narrowest part is located at the right), making the slide frame 55 slide to its leftmost position. On the other hand, when the widest parts of the shift cams 75 are located at the lowermost positions and the shift frame 54 is shifted downward to the lowermost position, the widest part of the slide cam 74 is located at the right (i.e., the narrowest part is located at the left), making the slide frame 55 slide to its rightmost position.

Figure 6:
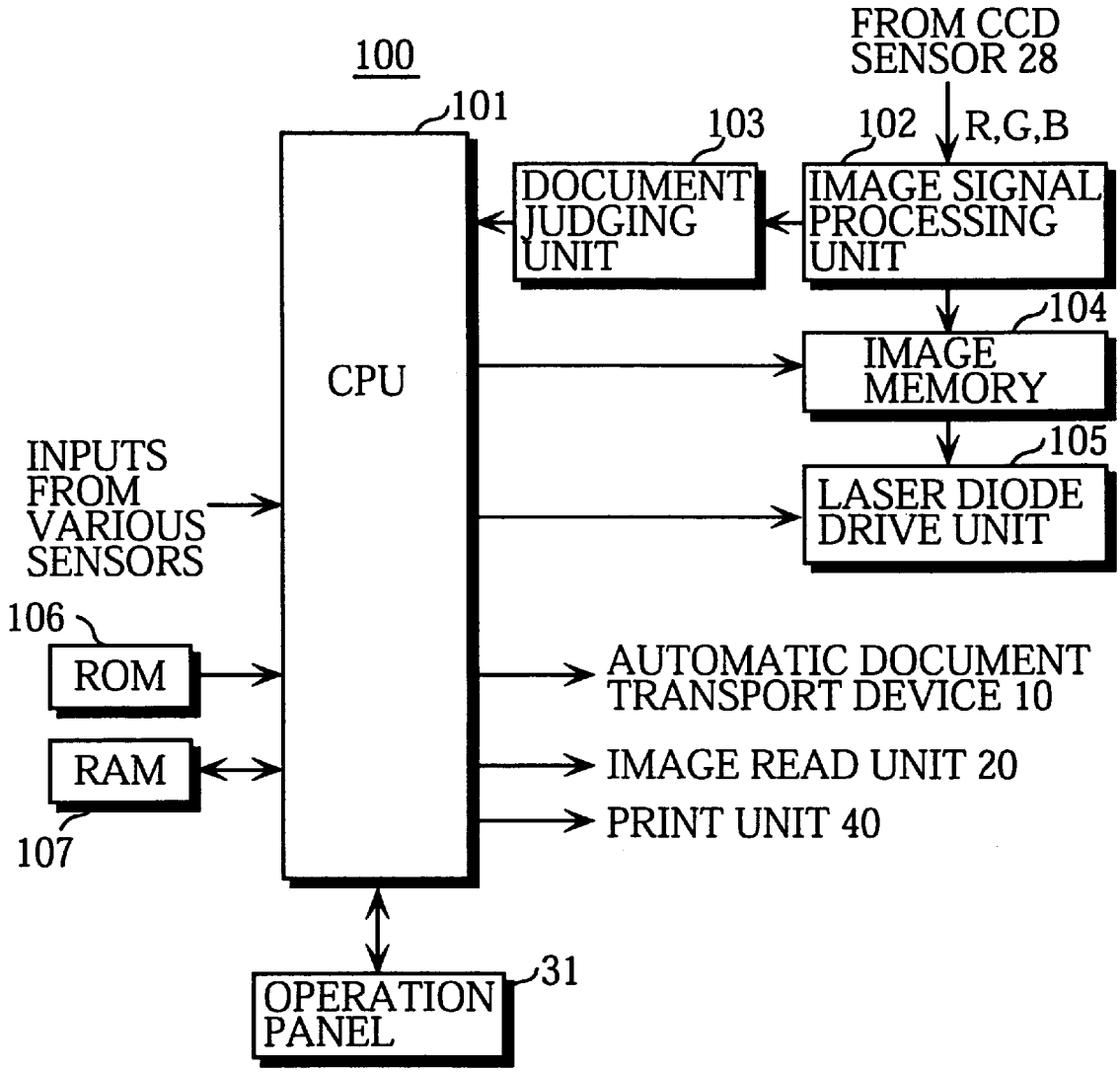
FIG. 6 is a block diagram showing the construction of a control unit of the digital full-color copying machine.

An operation panel 31 shown in FIG. 6 is provided on an optimum position on the top of the copier. The operation panel 31 is composed of a copy start key for indicating a start of copying, a numeric keypad for setting the number of copies, and various input keys including a key for selecting an auto-color mode or a full-color mode and seven color input keys for single-color copying. The operation panel 31 also includes a display unit for displaying a content set using the above keys. Here, in the auto-color mode, it is automatically judged whether a document is a color document or a black-and-white (referred to as "monochrome" hereinafter in this specification) document. If a document is judged to be color, image formation is performed with the four photosensitive drums 48C to 48K being operative, while if a document is judged to be monochrome, only the photosensitive drum 48K used for a black image formation is used. Meanwhile, in the full-color mode, the image formation is performed in a state where the four photosensitive drums 48C to 48K are all operative, regardless of a color type of a document. Each of the color input keys is assigned to one of seven colors, i.e., black, yellow, magenta, cyan, red, green, and blue. Regardless of read colors of a document, the image formation is performed using a color specified by one of the color input keys. For example, when yellow is specified, the image formation is performed using only the photosensitive drum 48Y, and when red is specified, the image formation is performed using only the photosensitive drums 48Y and 48M. When the image formation is performed for a monochrome document in the auto-color mode or when black is specified by the color input key, only the photosensitive drum 48K is used. This mode is referred to as "monochrome mode" hereinafter.

Next, the overall operation of the transfer unit 50 is explained for the case when the current mode is changed between the full-color mode and the monochrome mode is explained.

In FIG. 2, the transfer unit 50 is in the full-color mode. More specifically, the shift frame 54 is located at the uppermost position, the transport belt 51 is in contact with the four photosensitive drums 48C to 48K, the transfer backups 63C to 63K press the corresponding photosensitive drums 48C to 48K via the transport belt 51, and an optimum nip width is ensured between the transport belt 51 and the photosensitive drums 48C to 48K.

Figure 5:
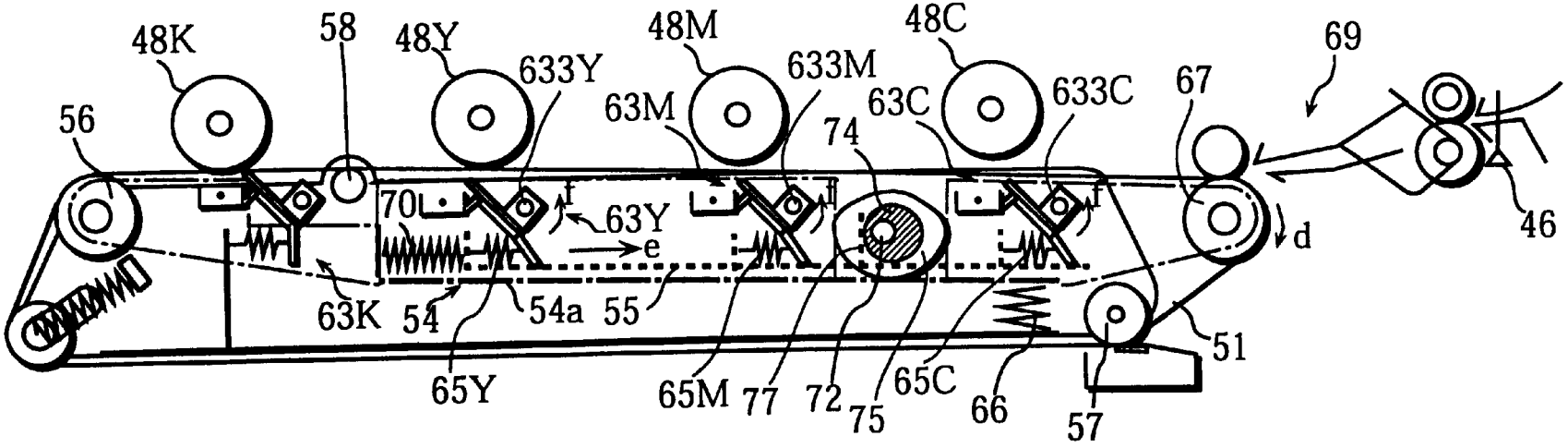
FIG. 5 is an enlarged view of the construction of the transfer unit of the digital full-color copying machine in the monochrome mode.

In order to change from the full-color mode to the monochrome mode, the cam driving motor 73 shown in FIG. 4 is activated. Once the cam shaft 72 is judged from the detection result given by the photo sensor 76*b* shown in FIG. 4 to have rotated by 180 degrees in the direction indicated by an arrow c, the shift cams 75 will be pushing down the base plate 54*a* of the shift frame 54 against the tension of the compressed spring 66. As a result, the shift frame 54 will have been shifted in the direction indicated by the arrow d, about the rotational axis of the slave roller 56, and so will be located at the lowermost position, as shown in FIG. 5.

Together with this movement, the section of the transport belt 51 between the assistance roller 58 and the drive roller 67 will have been shifted downward, as will have the section between the drive roller 67 and the slave roller 57. Thus, the transport belt 51 is separated from the photosensitive drums 48C to 48Y, leaving a sufficient space for the recording sheet S transported by the transport belt 51 to pass the photosensitive drums 48C to 48K without coming into contact with them. Meanwhile, an assistance roller 58 is provided for the photosensitive drum 48K and the transport belt 51, so that aside from the case where the recording sheet S needs to pass by the black image forming unit 41K without image formation being performed, the transport belt 51 can be kept in contact with the photosensitive drum 48K regardless of the position of the shift frame 54, i.e., regardless of whether monochrome mode or full-color mode is presently operational. In addition, an optimum nip width is secured between the transport belt 51 and the photosensitive drum 48K by the transfer backup 63K.

When the cam shaft 72 is rotated, the slide cam 74 also rotates and the part of the slide cam 74 which is in contact with the cam follower 77 will change from the widest part to the narrowest part. Consequently, the slide frame 55 slides to the right (that is, in the direction of the arrow e) in accordance with the tension of the compressed spring 70 and the left walls of the rectangle holes 71C to 71Y provided for the slide frame 55 to push the spring mounting units 634C to 634Y of the transfer backups 63C to 63Y to the right. As a result, the transfer backups 63C to 63Y rotate about the mounting holes 633C to 633Y in the direction indicated by the arrow f, and the backup blades 632C to 632Y are separated from the transport belt 51. Accordingly, unnecessary contact between the transfer backups 63C to 63Y and the transport belt 51 in the monochrome mode is avoided, and obstruction to the running of the transport belt 51 caused by unnecessary contacts is prevented, meaning that favorable image transfer is possible in the monochrome mode. In addition, unnecessary contact of the backup blades 632C to 632Y with the transport belt 51 is eliminated, thereby preventing needless wear and tear.

In accordance with the downward shift of the shift frame 54, the drive roller 67 is shifted, and together with this, the shift guide 69 is also shifted.

When the current mode is changed from the monochrome mode to the full-color mode, the cam shaft 72 further rotates by 180 degrees. This is to say, all the components move according to the reverse of the operation described above, and the state of the transfer unit 50 changes from the state in FIG. 5 to the state in FIG. 2.

FIG. 6 is a block diagram showing the construction of the control unit 100 provided in the copier. As shown in FIG. 6, the control unit 100 is composed of a CPU 101 as a central component, an image signal processing unit 102, a document judging unit 103, an image memory 104 for storing image data read by the read unit 20, a laser diode driving unit 105, a ROM 106 for storing programs required for the various control operations, and a RAM 107 serving as a work area for executing programs.

The image signal processing unit 102 performs modification processing (described later in this specification) on R, G, and B image data transmitted from the CCD color image sensor 28 of the image read unit 20 and transmits the processed image data for each page to the document judging unit 103. Simultaneously, the image signal processing unit 102 converts the image data into image data for each of the reproduction colors C, M, Y, and K that enables an optimum reproduced image to be obtained and transmits the image data to the image memory 104.

The document judging unit 103 judges whether each document is color or monochrome by performing data processing. (described later) on the image data of the documents transmitted from the image signal processing unit 102, and sends the judgement result to the CPU 101.

The CPU 101 stores the image data of the documents into the image memory 104, and forms a management table in which a storing position (i.e., an address) of the image data of each document is stored corresponding to the page number of the document and the judgement result given by the document judging unit 103, that is, whether the document is color or monochrome. This management table is then stored in the RAM 107.

The image memory 104 receives an instruction from the CPU 101 to read the image data of a specified address and then sends the image data stored in the specified address to the laser diode driving unit 105.

The laser diode driving unit 105 has the laser diodes scan the photosensitive drums 48C to 48Y in accordance with the image data sent from the image memory 104, based on a control program in the ROM 106.

The CPU 101 receives an input of detection signals of various sensors and controls the activation of the cam driving motor 73 and the timing of scanning performed by the laser diode driving unit 105 in accordance with a control program in the ROM 106.

The CPU 101 also receives various key inputs through the operation panel 31 and indicates respective operation timings to the automatic document transport device 10, the image read unit 20, and the print unit 40 in accordance with the set copying mode. In this way, the CPU 101 controls the overall operation of the components and realizes a smooth copying operation.

Figure 7:
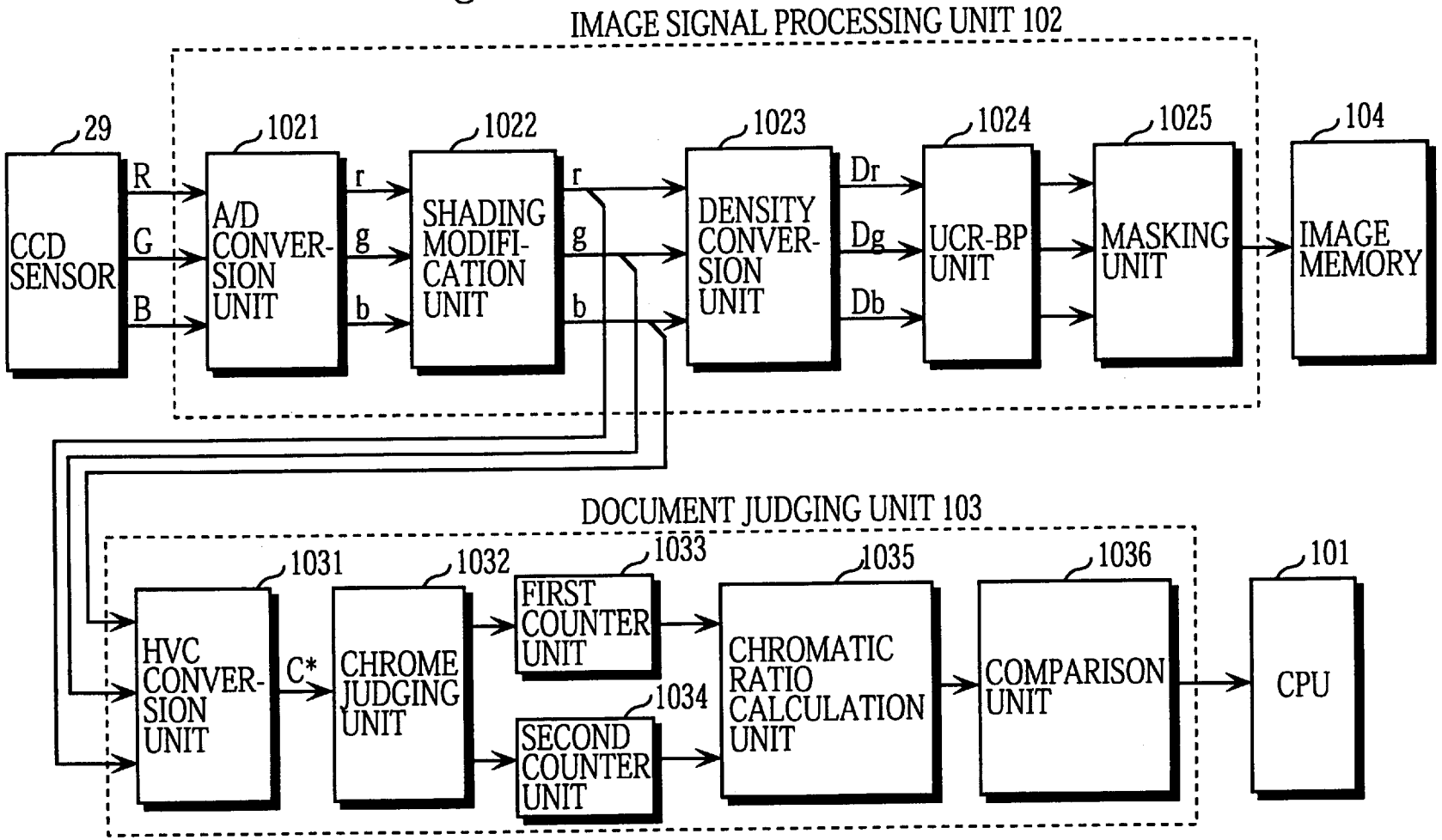
FIG. 7 is a block diagram showing the detailed constructions of an image signal processing unit and a document judging unit provided in the control unit.

FIG. 7 is a block diagram showing the constructions of the image signal processing unit 102 and the document judging unit 103.

Image signals, on which photoelectric transfer processing has been performed by the CCD color image sensor 28 of the image read unit 20, are converted into multivalued digital R, G, and B image data by an A/D conversion unit 1021. A predetermined shading modification is then performed on the converted image data by a shading modification unit 1022.

The shading-modified r, g, and b image data is sent to a density conversion unit 1023 and an HVC conversion unit 1031 which is provided in the document judging unit 103.

The shading-modified image data sent to the density conversion unit 1023 is converted into Dr, Dg, and Db density data for the actual printed image. After this, a UCR-BP (Undercolor Removal-black Paint) unit 1024 performs black paint (BP) processing by calculating a predetermined ratio of a common part of the density data for the three colors as a black density to improve reproduction of black, as well as performing undercolor removing (UCR) processing to deduct the black density from the image data of the three colors.

A masking processing unit 1025 performs linear modification processing on the image data for Dr, Dg, and Db, on which the BP processing and the UCR processing have been performed, to make the color reproduction as ideal as possible. Then, the image data is converted into the density data for C, M, Y, and K, and is sent to the image memory 104 where the density data C, M, Y, and K is stored for each page.

Meanwhile, the image data R, G, and B sent from the shading modification unit 1022 to the HVC conversion unit 1031 of the document judging unit 103 is converted into data for Hue angle (H*), Value (V) and Chroma (C*) of a color area signal in a uniform color space of the Munsell color system in accordance with predetermined conversion equations. Of this data, the Chroma (C*) data is sequentially sent to a chroma judging unit 1032 for each pixel.

In accordance with the Chroma (C*) data inputted from the HVC conversion unit 1031, the chroma judging unit 1032 judges whether each pixel is chromatic or achromatic. The chroma judging unit 1032 has a predetermined threshold as a judgement standard and judges whether a pixel is chromatic or achromatic by checking whether the value of the Chroma (C*) data exceeds the predetermined threshold. The chroma judging unit 1032 sequentially transmits a predetermined signal to a first counter unit 1033 on judging that a pixel is chromatic, and to a second counter unit 1034 on judging that a pixel is achromatic.

On completing the transmission of the predetermined signals for the pixel data of one page, the chroma judging unit 1032 sends a page completion signal to both the first counter unit 1033 and the second counter unit 1034.

The first counter unit 1033 and the second counter unit 1034 increment respective internal counters by "1" whenever a predetermined signal is received from the chroma judging unit 1032. On receiving the page completion signal, the first counter unit 1033 and the second counter unit 1034 send the respective count values to a chromatic ratio calculation unit 1035 and reset the count values.

The chromatic ratio calculation unit 1035 divides the value inputted from the first counter unit 1033 (i.e., the number of the chromatic pixels) by the sum of the values inputted from the first counter unit 1033 and the second counter unit 1034 (i.e., the number of the chromatic-pixels+ the number of the achromatic pixels) to obtain the ratio of the number of the chromatic pixels to the number of pixels in the page. The calculated ratio is sent to a comparison unit 1036.

The comparison unit 1036 compares the calculated ratio value inputted from the chromatic ratio calculation unit 1035 with a predetermined ratio value, 0.01 (i.e., 1%) for example. If the calculated value is equal to or above the predetermined value, the comparison unit 1036 judges that the document is chromatic, that is, the document is color. If hot, the comparison unit 1036 judges the document is achromatic, that is, the document is monochrome. The comparison unit 1036 then sends the judgement result to the CPU 101. It should be noted here that the predetermined value is not limited to 1%, and it may be 0.1% for a more precise judgement as to whether a document is color or monochrome. Note that the CPU 101 can easily judge the copy mode of a document by reading the management table in the RAM 107, which stores the page number of the document and the color judgement result given by the document judging unit 103 corresponding to the storing position (the address) of the image data in the image memory 104.

Accordingly, the copy mode of the image formation can be judged for each document, so that the copier can perform copying operations by sequentially transporting a plurality of documents including both color and monochrome documents to the platen glass 21 using the automatic document transport device 10.

The RAM 107 has a mode setting flag which indicates the current mode. When the mode setting flag is "0", the current mode is monochrome mode, and, when "1", the current mode is full-color mode.

Figure 8:
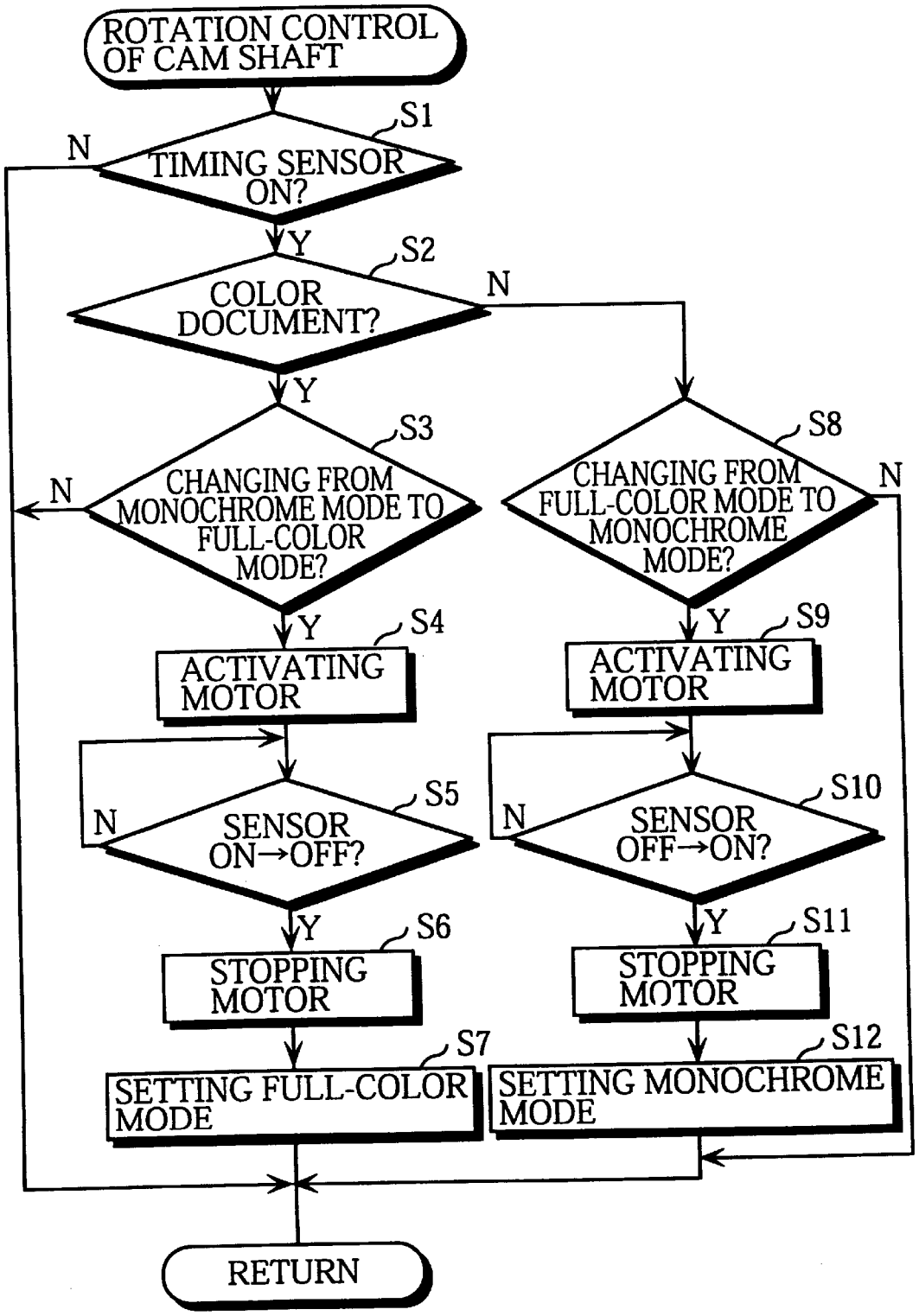
FIG. 8 is a flowchart showing the rotation control of a cam axis of the digital full-color copying machine.

Next, the rotation control of the cam shaft 72 is described, with reference to the flowchart of FIG. 8. It should be noted here that the following description applies to the case when the auto color mode is selected. In the auto color mode, the mode is automatically changed between the monochrome mode and the full-color mode depending on whether the read document image is monochrome or color.

When the timing sensor 46 is turned ON by the edge of a recording sheet onto which an image is to be transferred ("Yes" in step S1), the CPU 101 refers to the management table and judges whether a document image which is to be transferred on the recording sheet is color or monochrome (step S2). If the document is color, the CPU 101 proceeds to step S3 and refers to the mode setting flag to judge whether the current mode needs to be changed from the monochrome mode to the full-color mode. If so (that is, the mode setting flag is "0"), the CPU 101 activates the cam driving motor 73 (step S4). When the output signal from the photo sensor 76*b* is changed from ON to OFF ("Yes" in step 5S), that is, when the widest parts of the shift cams 75 shown in FIG. 4 are located at the lowermost position, the CPU 101 stops the cam driving motor 73 (step S6). Then, the CPU 101 sets the mode setting flag from "0" to "1" (step S7) and returns to the main flow.

Meanwhile, if the document is judged as monochrome in step S2, the CPU 101 proceeds to step S8 and refers to the mode setting flag to judge whether the current mode needs to be changed from the full-color mode to the monochrome mode. If so (that is, the mode setting flag is "1"), the CPU 101 activates the cam driving motor 73 (step S9). When the output signal from the photo sensor 76*b* is changed from OFF to ON ("Yes" in step S10), that is, the widest parts of the shift cam 75 shown in FIG. 4 are located at the uppermost position, the CPU 101 stops the cam driving motor 73 (step S11). Then, the CPU 101 sets the mode setting flag from "1" to "0" (step S12) and returns to the main flow.

As described above, with the image forming apparatus of the present invention, the backup blades 632C to 632Y of the transfer backups 63C to 63Y provided for the corresponding photosensitive drums 48C to 48Y which are not used for an image formation in the monochrome mode are separated from the transport belt 51, so that the backup blades 632C to 632Y do not adversely affect the running of the transport belt 51. This prevents deterioration in the transferred image due to uneven running of the transport belt 51.

In addition, unnecessary contact of the backup blades 632C to 632Y with the transport belt 51 is eliminated, preventing needless wear and tear.

In the present embodiment, once a complete copying operation has been performed, that is, when the copier is on standby, the transfer unit 50 may return to the state of the monochrome mode shown in FIG. 5, regardless of the current mode. Here, while the backup blades 632C to 632Y are separated from the transport belt 51, a solenoid may be provided for the transfer backup 63K shown in FIG. 3. By means of this solenoid, the spring mounting unit 634K may be pulled to the right, and accordingly, the transfer backup 63K may be rotated counterclockwise so that the backup blade 632K may also be separated from the transport belt 51. If the transport belt is pressed by the backup blade for long periods of time when not in motion, a depression may be formed at the pressed position, which can lead to discrepancies in charging characteristics at different positions on the transport belt. This in turn can lead to deterioration in the quality of the reproduced image. Similarly, discrepancies in charging characteristics may emerge between a position on a photosensitive drum that is pressed by the transport belt and other positions on the drum, although these problems may be avoided by providing a solenoid to withdraw the backup blade as described above.

Second Embodiment

Figure 9:
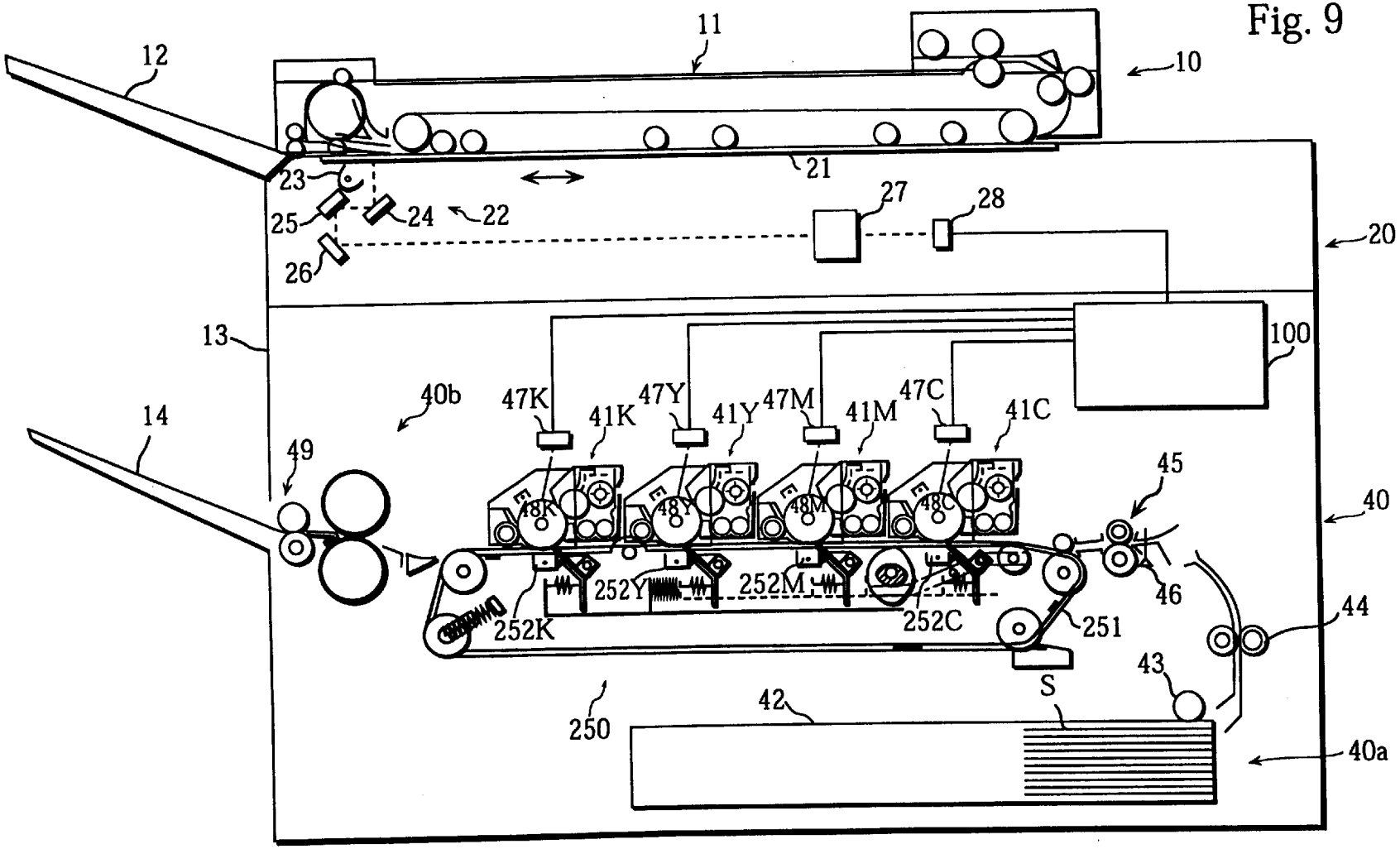
FIG. 9 shows the overall construction of a digital full-color copying machine of the second embodiment.

The image forming apparatus of the second embodiment is the same as the image forming apparatus of the first embodiment, except for the construction of the transfer unit as shown in the front view of FIG. 9 and certain control operations of the CPU. Therefore, the explanation of the common aspects is omitted and only the different components are explained.

Figure 10:
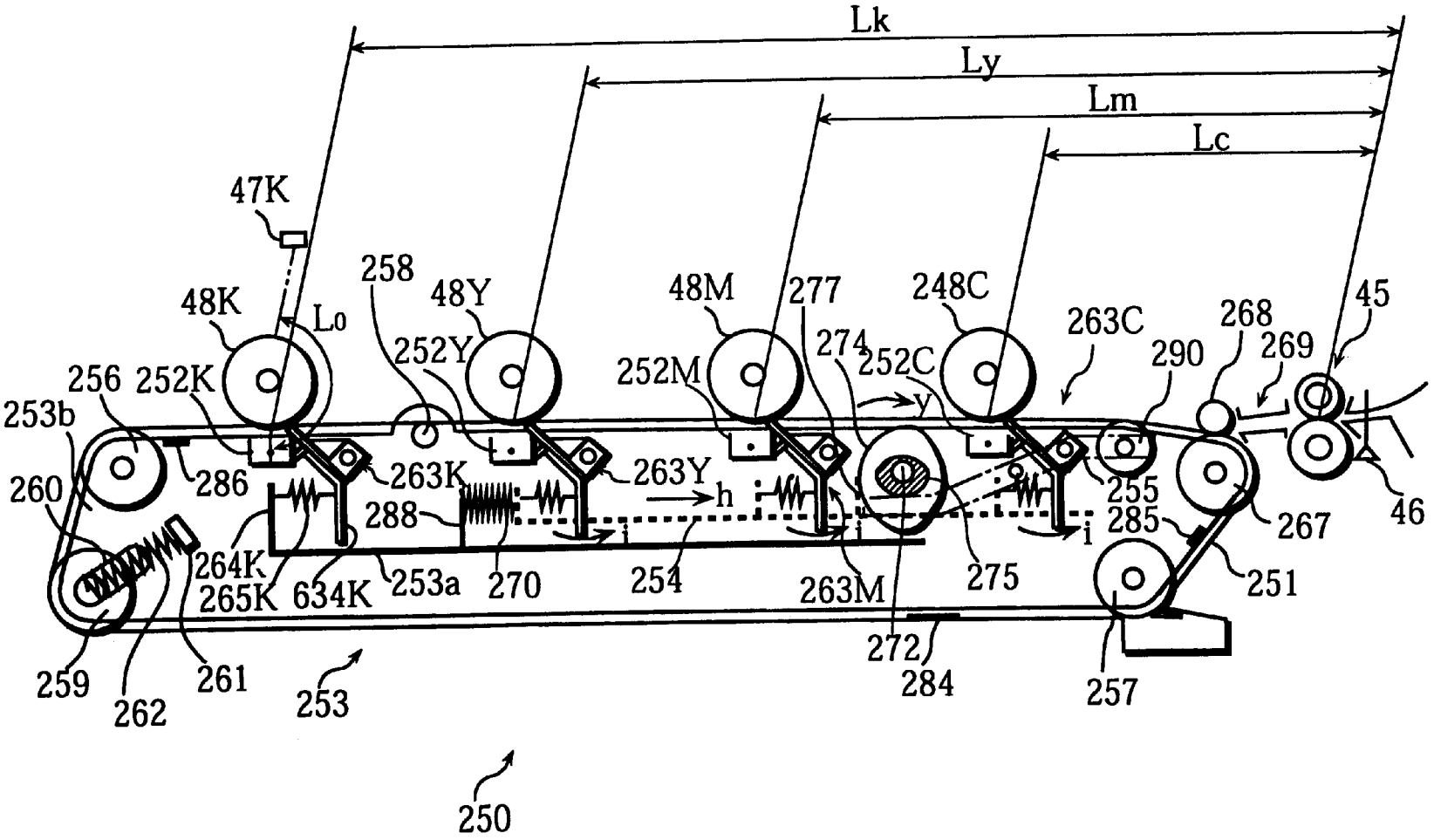
FIG. 10 is an enlarged view of the construction of a transfer unit of the digital full-color copying machine in the full-color mode in the second embodiment.
Figure 11:
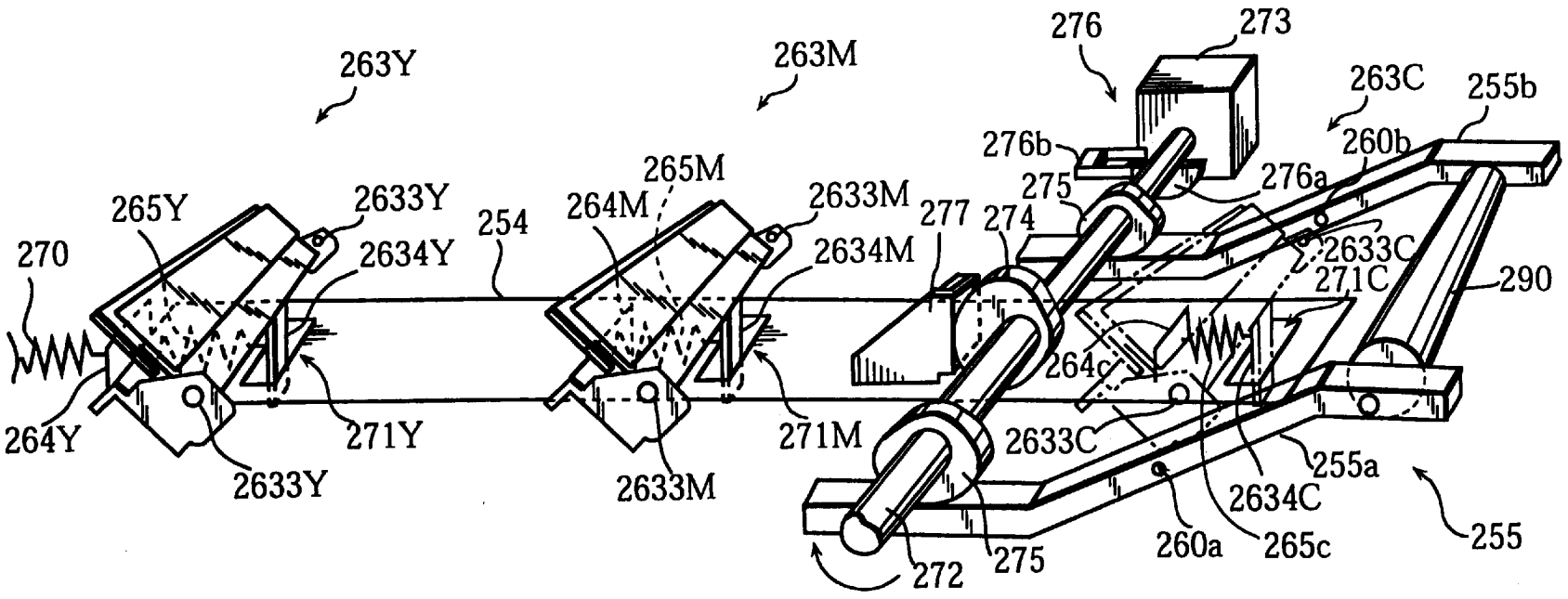
FIG. 11 is a perspective view of part of the transfer unit.
Figure 12:
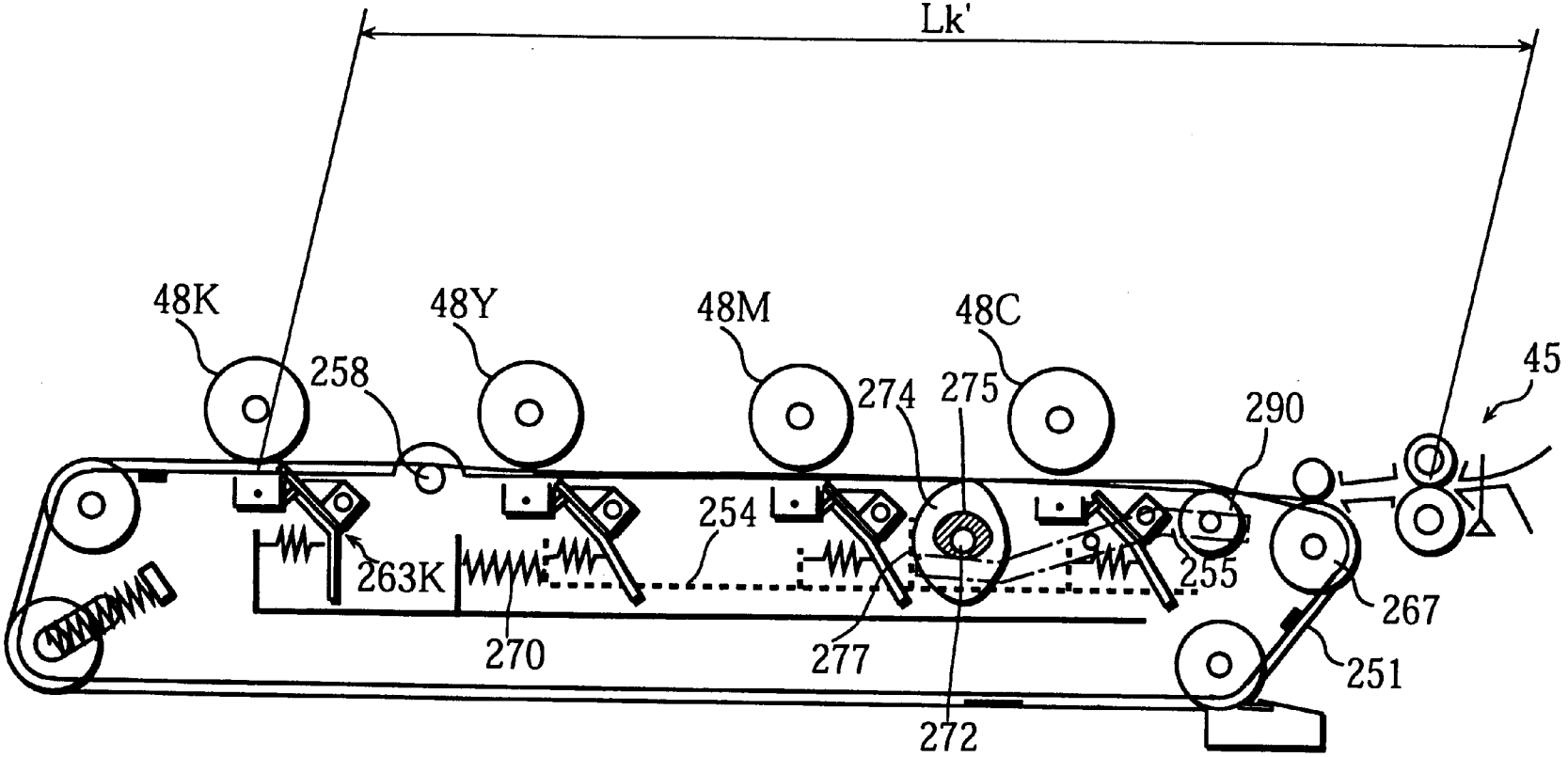
FIG. 12 is an enlarged view of the construction of the transfer unit of the digital full-color copying machine in the monochrome mode.

The following is a description of the construction of a transfer unit 250 used in the second embodiment, with reference to FIG. 10 to FIG. 12.

FIG. 10 shows a front view of the transfer unit 250. The transfer unit 250 is composed of a main frame 253, a slide frame 254, and a shift lever 255. In FIG. 10, the main frame 253 is shown by a solid line, the slide frame 254 by a dotted line, and the shift lever 255 by a dot-dash line.

The main frame 253 is formed of a base plate 253*a* that has a predetermined width (parallel to the viewing direction in FIG. 10) and side plates 253*b* on the front side and the rear side of the base plate 253*a* (as the copier is viewed in FIG. 2). Rotation axes of slave rollers 256 and 257, an assistance roller 258, a tension roller 259, and a drive roller 267 are set to freely rotate at the positions on the side plates 253*b* shown in FIG. 10 via respective bearings (not illustrated). The bearings of the tension roller 259 are held in rounded rectangular holes 260 which longitudinally extend upward and to the right, with the axis of the tension roller 259 passing through the holes 260. The bearings are held by the tension of compressed springs 262 which are set between the bearings and spring mounting elements 261 that are set on the side plates 253*b* and protrude outward. The tension roller 259 keeps the tension of a transport belt 251 constant. A motor (not illustrated) for driving the drive roller 267 is fixed to one of the side plates 253*b*, with an output axis of the motor and the rotation axis of the drive roller 267 being coupled.

The transport belt 251 is made up of transparent polyethylene terephthalate (PET), and runs around the rollers described above. Reflecting tape 284 is affixed to a position on the inward surface of the transport belt 251 which does not affect image formation. Reflectance-type photo sensors 285 and 286 are mounted on the side plates 253*b* via mounting elements (not illustrated). The photo sensor 285 is set between the slave roller 257 and the drive roller 267, and the photo sensor 286 is set between the photosensitive drum 48K and the slave roller 256, with respective set positions being located for the detection of the reflecting tape 284 which moves as the transport belt 251 is rotated.

A charging roller 268 for pressing the surface of the drive roller 267 rotates together with the drive roller 267, with the transport belt 251 running between these rollers. In addition, the charging roller 268 serves as a charger which charges a recording sheet fed by the pair of synchronizing rollers 45, so that the recording sheet is securely attracted to the transport belt 251. It should be noted here that a separating charger is set on the left (as viewed in FIG. 2) of the photosensitive drum 48K. By means of this separating charger, the recording sheet on which a toner image is transferred is separated from the transport belt 251. A guiding component 269 for guiding the recording sheet is set between the pair of synchronizing rollers 45 and the drive roller 267 via a mounting component (not illustrated) set on the side plates 253*b* of the main frame 253.

Transfer chargers 252C to 252K are set between the side plates 253*b* of the main frame 253, being located directly under the photosensitive drums 48C to 48K with a certain space between them. Here, with the certain space, when the transport belt 251 provided between the photosensitive drums 48C to 48K and the sensitizing units (nor illustrated) shift as described later, the transfer chargers 252C to 252K do not contact the transport belt 251.

Transfer backups 263C to 263K are respectively set on the right (as viewed in FIG. 10) of the corresponding transfer chargers 252C to 252K. The transfer backups 263C to 263K are set on the main frame 253 in the same way as shown in FIG. 3 in the first embodiment. The construction of the transfer backups in the present embodiment is also the same as in the first embodiment. Therefore, the explanation of the installation and construction of the transfer backups 263C to 263K are omitted in the present embodiment.

The slide frame 254 is set above the base plate 253*a* via a guiding component (not illustrated) between the side plates 253*b* of the main frame 253, being set to freely slide sideways in a longitudinal direction. A compressed spring 270 is set between the left side (as viewed in FIG. 10) of the slide frame 254 and a spring mounting component 288 standing on the central part of the base plate 253*a* of the main frame 253. As shown in FIG. 11, spring mounting components 264C to 264Y corresponding to the transfer backups 263C to 263Y are provided on the slide frame 254. Tensile springs 265C to 265Y are mounted between the spring mounting components 264C to 264Y and corresponding spring mounting units 2634C to 2634Y of the transfer backups 263C to 263Y. The slide frame 254 is further provided with rectangle holes 271C to 271Y into which the lower parts of the spring mounting units 2634C to 2634k of the transfer backups 263C to 263Y are inserted. When the slide frame 254 slides to the right (as the copier is viewed in FIG. 10), the left side walls of the rectangular holes 271C to 271Y push the spring mounting units 2634C to 2634Y to the right, and as a result, the transfer backups 263C to 263Y turn counterclockwise. When the spring mounting units 2634C to 2634Y and the walls of the rectangle holes 271C to 271Y are not in contact as shown in FIG. 11, the spring mounting units 2634C to 2634Y are pulled toward the left by the tension of the tensile springs 265C to 265Y, and accordingly, the transfer backups 263C to 263Y turn clockwise to touch the transport belt 251.

As shown in FIG. 11, the shift lever 255 is composed of lever components 255*a* and 255*b*. The lever component 255*a* is mounted on the front side frame 253*b* of the main frame 253 while the lever component 255*b* is mounted on the rear side frame 253*b* using respective mounting components (not illustrated) via respective mounting holes 260*a* and 260*b*, with these lever components 255*a* and 255*b* freely rotating. A shift roller 290 is also mounted on the right part (as viewed in FIG. 11) of the shift lever 255 to freely rotate, being set between the lever components 255*a* and 255*b*.

A cam shaft 272 is set to freely rotate between the side plates 253*b* of the main frame 253 (shown in FIG. 10) via bearings (not illustrated), with one end of the cam shaft 272 being coupled to an output axis of a cam driving motor 273 composed of such as a DC (Direct Current) motor. The cam shaft 272 is provided with a slide cam 274 for sliding the slide frame 254, a pair of shift cams 275 for shifting the shift lever 255, and a detection plate 276*a* which is used when detecting a rotation position of the cams.

The slide cam 274 is always in contact with a cam follower 277 set on the slide frame 254 which is pushed toward the right by the tension of the compressed spring 270. In accordance with the rotation of the slide cam 274, the slide frame 254 can slide sideways by the difference in width between the widest and the narrowest parts of the slide cam 274.

The shift cams 275 are always in contact with the upper surface of the left parts of the shift lever 255. When rotated, the shift cams 275 shift the shift roller 290 up and down by the difference between the widest and the narrowest parts of the shift cams 275, with the mounting holes 260*a* and 260*b* serving as a center of rotation.

The detection plate 276*a* is made up of a semicircular plate. The photo sensor 276*b* is composed of a light-emitting element and a light-detecting element which face each other and are set on opposite sides of the detection plate 276*a*. The detection plate 276*a* and the photo sensor 276*b* comprise a rotation position detection unit 276. If the detection plate 276*a* is located between the light-emitting element and the light-detecting element, the photo sensor 276*b* outputs an OFF signal, or if not, the photo sensor 276*b* outputs an ON signal. This is to say, every time the detection plate 276*a* rotates 180 degrees, the signal outputted from the photo sensor 276*b* changes from ON to OFF, or alternatively, from OFF to ON. In accordance with this detection result, the rotation position Z. of the cam shaft 272 provided with the detection plate 276*a* can be controlled for every 180-degree rotation. By means of the detection plate 276*a*, an output signal outputted from the photo sensor 276*b* changes from ON to OFF when the widest parts of the shift cams 275 are located at the lowermost position, and changes from OFF to ON when the widest parts of the shift cams 275 are located at the uppermost position. Here, the shift cams 275 rotate together with the rotation of the cam shaft 272 in the direction indicated by the arrow in FIG. 11.

The rotation control of the cam driving motor 273 which rotates the cam shaft 272 provided with these cams is performed by the control unit 100. The control unit 100 detects the rotation positions of the shift cams 275 using the photo sensor 276*b* and activates/stops the cam driving motor 273 and to have the left part of the shift lever 255 stop at the uppermost position or the lowermost position.

As shown in FIG. 11, the widest parts of the shift cams 275 and the widest part of the slide cam 274 are out of phase with each other by 90 degrees. As such, when the widest parts of the shift cams 275 are located at the upper positions (i.e., the narrowest parts are located at the lower positions) and the left part of the shift lever 255 is located at the uppermost position, the widest part of the slide cam 274 is located at the right (i.e., the narrowest part is located at the left), making the slide frame 254 slide to its rightmost position. On the other hand, when the widest parts of the shift cams 275 are located at the lowermost positions and the left part of the shift lever 255 is pushed down to the lowermost position, the widest part of the slide cam 274 is located at the left (i.e., the narrowest part is located at the right side), making the slide frame 254 slide to its leftmost position.

An operation panel 31 is provided on an optimum position on the top of the copier. This operation panel 31 is the same as the operation panel 31 (shown in FIG. 6) of the first embodiment, and therefore, the explanation is omitted.

Next, the overall operation of the transfer unit 250 is explained for the case when the current mode is changed between the full-color mode and the monochrome mode is explained.

In FIG. 10, the transfer unit 250 is in the full-color mode. More specifically, the right part of the shift lever 255 is shifted upward with the left part pushed down by the shift cams 275, and accordingly, the shift roller 290 is in its uppermost position. As a result, the transport belt 251 is pushed up and comes into contact with the four photosensitive drums 48C to 48K, the transfer backups 263C to 263K press the corresponding photosensitive drums 48C to 48K through the transport belt 251, and an optimum nip width between the transport belt 251 and the photosensitive drums 48C to 48K is ensured.

In order to change from the full-color mode to the monochrome mode, the cam driving motor 273 shown in FIG. 11 is activated. If the cam shaft 272 is judged from the detection result given by the photo sensor 276*b* shown in FIG. 11 to have been rotated by 180 degrees in the direction indicated by an arrow y, the shift lever 255 is rotated clockwise by a force due to its own weight (including the weight of the shift roller 290) or due to the force of the transport belt 251 which acts via the shift roller 290. As a result, the shift roller 290 moves to its lowermost position, as shown in FIG. 12.

Consequently, the section of the transport belt 251 between the assistance roller 258 and the drive roller 267 will have been shifted downward, and accordingly, the transport belt 251 will have been separated from the photosensitive drums 48C to 48Y, leaving a sufficient space for the recording sheet transported by the transport belt 251 to pass the photosensitive drums 48C to 48Y. Meanwhile, an assistance roller 258 is provided for the photosensitive drum 48K and the transport belt 251, so that aside from the case where the recording sheet needs to pass by the black image forming unit 41K without image formation being performed, the transport belt 251 can be kept in contact with the photosensitive drum 48K regardless of the position of the shift frame 254, i.e., regardless of whether monochrome mode or full-color mode is presently operational. In addition, an optimum nip width is secured between the transport belt 251 and the photosensitive drum 48K by the transfer backup 263K.

When the cam shaft 272 is rotated, the slide cam 274 also rotates and the part of the slide cam 274 which is in contact with the cam follower 277 will change from the widest part to the narrowest part. Consequently, the slide frame 254 slides to the right (that is, in the direction of the arrow h in FIG. 10) in accordance with the tension of the compressed spring 270, and the left walls of the rectangle holes 271C to 271Y shown in FIG. 11 provided for the slide frame 254 push the spring mounting units 2634C to 2634Y of the transfer backups 263C to 263Y to the right. As a result, the transfer backups 263C to 263Y rotate about the mounting holes 2633C to 2633Y in the direction indicated by the arrow i, and the backup blades 2632C to 2632Y are separated from the transport belt 251.

When the current mode is changed from the monochrome mode to the full-color mode, the cam shaft 272 further rotates by 180 degrees. This is to say, all the components move according to the reverse of the stated operation, and the state of the transfer unit 250 is changed from the state in FIG. 12 to the state in FIG. 10.

The control unit 100 and the image signal processing unit 102 and the document judging unit 103 of the control unit 100, which are all provided in the copier of the second embodiment, are the same as those explained with reference to FIGS. 6 and 7 in the first embodiment. Therefore, the explanation is not given in the present embodiment.

The ROM 106 used in the second embodiment previously stores a time period between the start time of supplying a recording sheet to the transport belt 251 by the pair of synchronizing rollers 45, that is, when the timing clutch is turned ON, and the start time of scanning the surface of the photosensitive drums 48C to 48K by the laser diode drive unit 105 (hereinafter, this time is referred to as the "scan waiting time"), for each photosensitive drum. Here, the scan waiting time is obtained as described below.

Note that the current mode of the transfer unit 250 is the full-color mode as shown in FIG. 10. The lengths of the transportation path of a recording sheet (referred to as the "transportation path length" hereinafter), that is, between the position where the edge of the recording sheet touches the pair of synchronizing rollers 45 and the respective transfer positions where images are respectively transferred onto the recording sheet by the photosensitive drums 48C to 48K and the corresponding transfer chargers 252C to 252K, are referred to as Lc to Lk. Also, note that the length along the circumference of each photosensitive drum (all four photosensitive drums having the same diameter) from the scanning position to the transfer position is measured and referred to as Lo, and the transport speed of the transport belt 251 is referred as V. The transport speed of the transport belt 251, the rotation speed of the synchronizing roller 45, and the rotation speed of the photosensitive drums are the same. Here, the scan waiting times Tc to Tk of the photosensitive drums 48C to 48K are obtained using the following equations.

$$Tc=(Lc-Lo)/V$$

$$Tm=(Lm-Lo)/V$$

$$Ty=(Ly-Lo)/V$$

$$Tk=(Lk-Lo)V$$

As shown in FIG. 12, the transportation path length toward the photosensitive drum 48K in the monochrome mode is shorter than that in the case of the full-color mode. Here, the shorter transportation path period is referred to as Lk'. For this reason, the time period between when a recording sheet is supplied to the transport belt 251 by the pair of synchronizing rollers 45 and when the recording sheet reaches the transfer position under the photosensitive drum 48K used for black image formation in the monochrome mode, is different from the time period in the full-color mode (this difference time is referred to as the "mode time difference"). More specifically, the time period in the monochrome mode is shorter than that in the full-color mode, and the time difference can be obtained using the following equation.

$$\Delta t=(Lk-Lk')/V$$

Here, the scan waiting time of the photosensitive drum 48K in the monochrome mode, which is referred to as Tk', is shortened by the mode time difference Δt. The value Tk' is obtained using the following equation.

$Tk'=Tk-\Delta t$

It should be noted here that the ROM 106 stores Tc to Tk, with Tk' being obtained by executing a calculation for subtracting Δt from Tk as necessary. The mode time difference Δt is obtained through actual measurement as follows.

The shift roller 290 pushes the transport belt 251 up and down, and as a result, the transportation path length toward the photosensitive drum 48K fluctuates in accordance with the fluctuation in the length of the transport belt 251 between the drive roller 267 and the assistance roller 258. Therefore, when an arbitrary point on the transport belt 251 passes through this section between the drive roller 267 and the assistance roller 258, the passing time is different between the monochrome mode and the full-color mode. This passing time difference is the mode time difference Δt.

Figure 13:
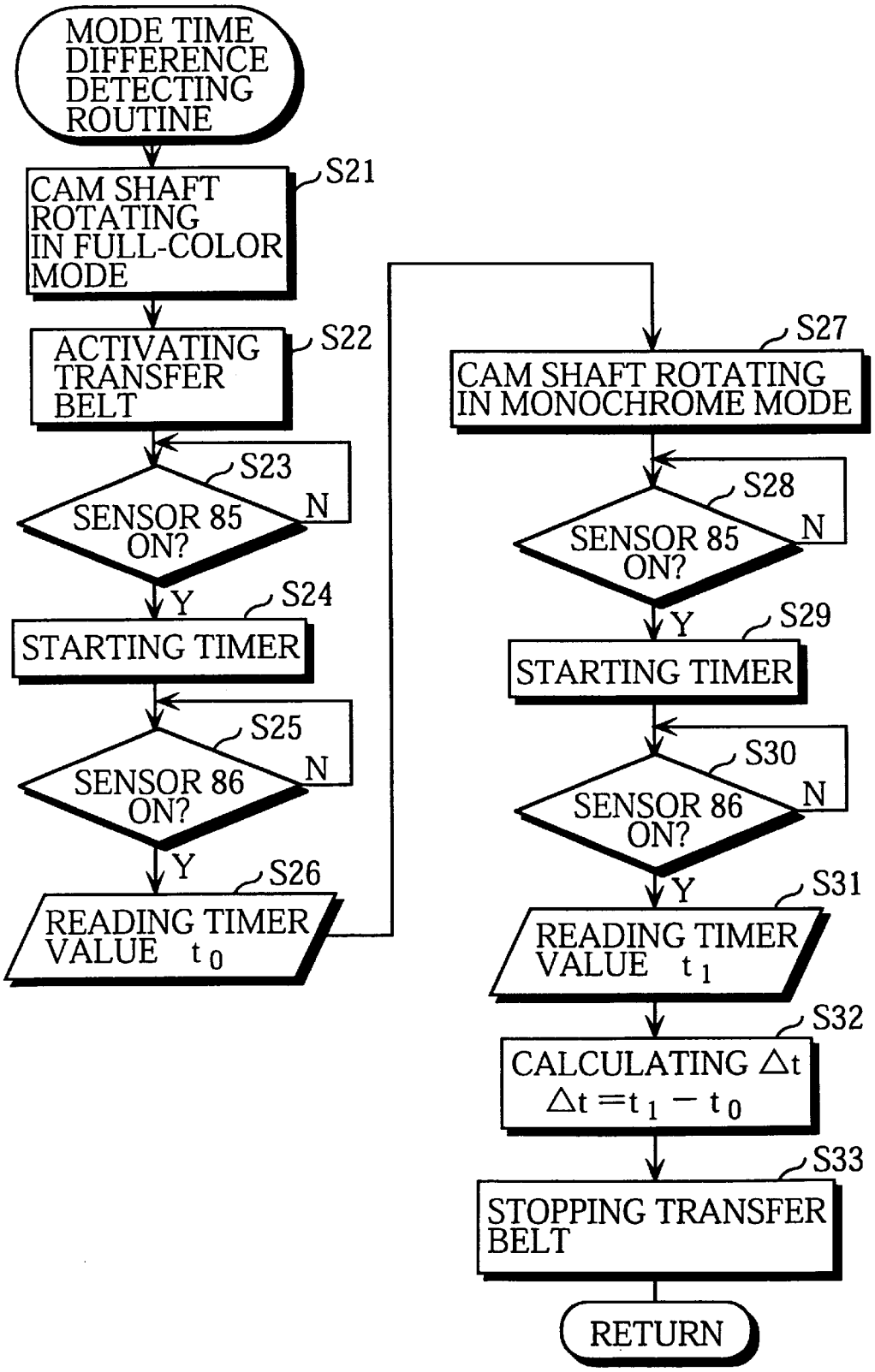
FIG. 13 is a flowchart showing the mode time difference detecting routine of the digital full-color copying machine.

Processing for obtaining the mode time difference Δt is explained as follows, with reference to the flowchart of FIG. 13.

The CPU 101 rotates the cam shaft 272 and has the shift roller 290 moved to its uppermost position, i.e., the same position as in the full-color mode (step S21). Then the CPU 101 activates the transport belt 251 (step S22).

When the photo sensor 285 is turned ON by the edge of the reflecting tape 284 (Yes in step S23), an internal timer of the CPU 101 starts counting (step S24). When the photo sensor 286 is turned ON by the edge of the reflecting tape 284 (Yes in step S25), the CPU 101 reads the current value t0 of the timer and stores the value in the RAM 107 (step S26).

After this, the CPU rotates the cam shaft 272 and has the shift roller 290 moved to its lowermost position, i.e., the same position as in the monochrome mode (step S27). When the photo sensor 285 is turned ON by the edge of the reflecting tape 284 (Yes in step S28), the internal timer of the CPU 101 starts counting (step S29). When the photo sensor 286 is turned ON by the edge of the reflecting tape 284 (Yes in step S30), the CPU 101 reads the current value t1 of the timer and stores the value in the RAM 107 (step S31).

The mode time difference Δt is obtained by subtracting t0 stored in the RAM 107 from t1 stored in the RAM 107 (step S32), and the CPU 101 stops the transport belt 251 (step S33).

It should be noted here that the detection of Δt is performed when the power of the copier is turned on, and the detection result is stored in the RAM 107. The value of Δt fluctuates depending on the surrounding conditions, such as the temperature inside the copier, so that the detection of Δt may be performed as necessary and the value of Δt may be updated. For example, when the copier has been on standby for more than two hours, the detection of Δt may be performed after jam detection processing.

Figure 14:
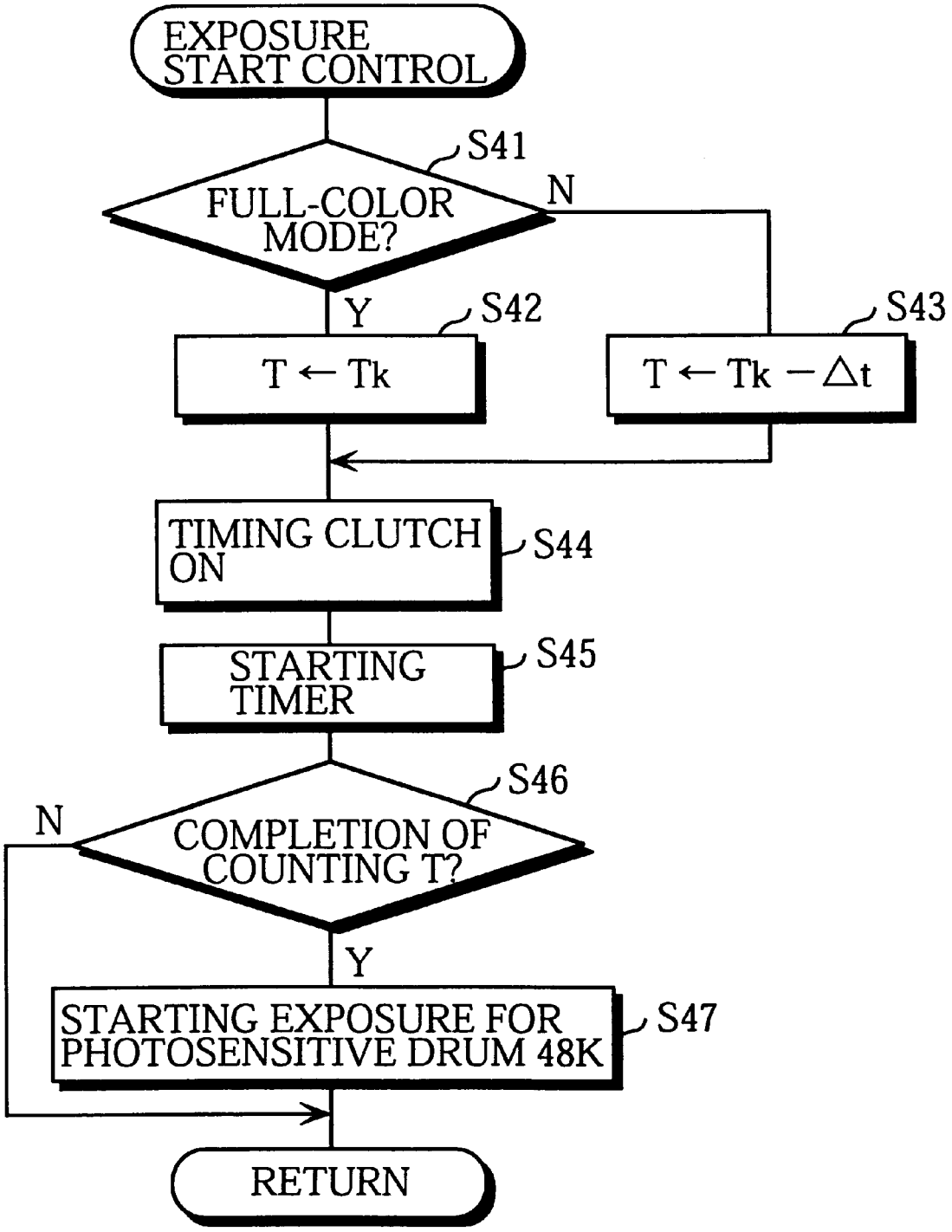
FIG. 14 is a flowchart showing the exposure starting control of a photosensitive drum for a black image formation.

The rotation control of the cam axis in the second embodiment is the same as that explained using the flowchart of FIG. 8 in the first embodiment, and therefore, no explanation is given in the second embodiment. Next, of the exposure start controls performed after the rotation control of the cam shaft 272, the exposure start control of the photosensitive drum 48K used for black image formations is described, with reference to the flowchart in FIG. 14.

The CPU 101 judges whether the current mode is the full-color mode by referring to the mode setting flag (step S41). If so, the CPU 101 sets Tk as the scan waiting time T (step S42), and, if not (that is, the current mode is the monochrome mode), the CPU 101 sets "Tk–Δt" as the scan waiting time T (step S43). The CPU 101 then proceeds to step S44.

In step S44, the CPU 101 turns the timing clutch ON and starts supplying a recording sheet to the transport belt 251 as well as starting the internal timer of the CPU 101 (step S45). After counting the scan waiting time T by the internal timer (Yes in step S46), the CPU 101 starts the scanning of the photosensitive drum 48K used for black image formations (step S47).

Figure 15:
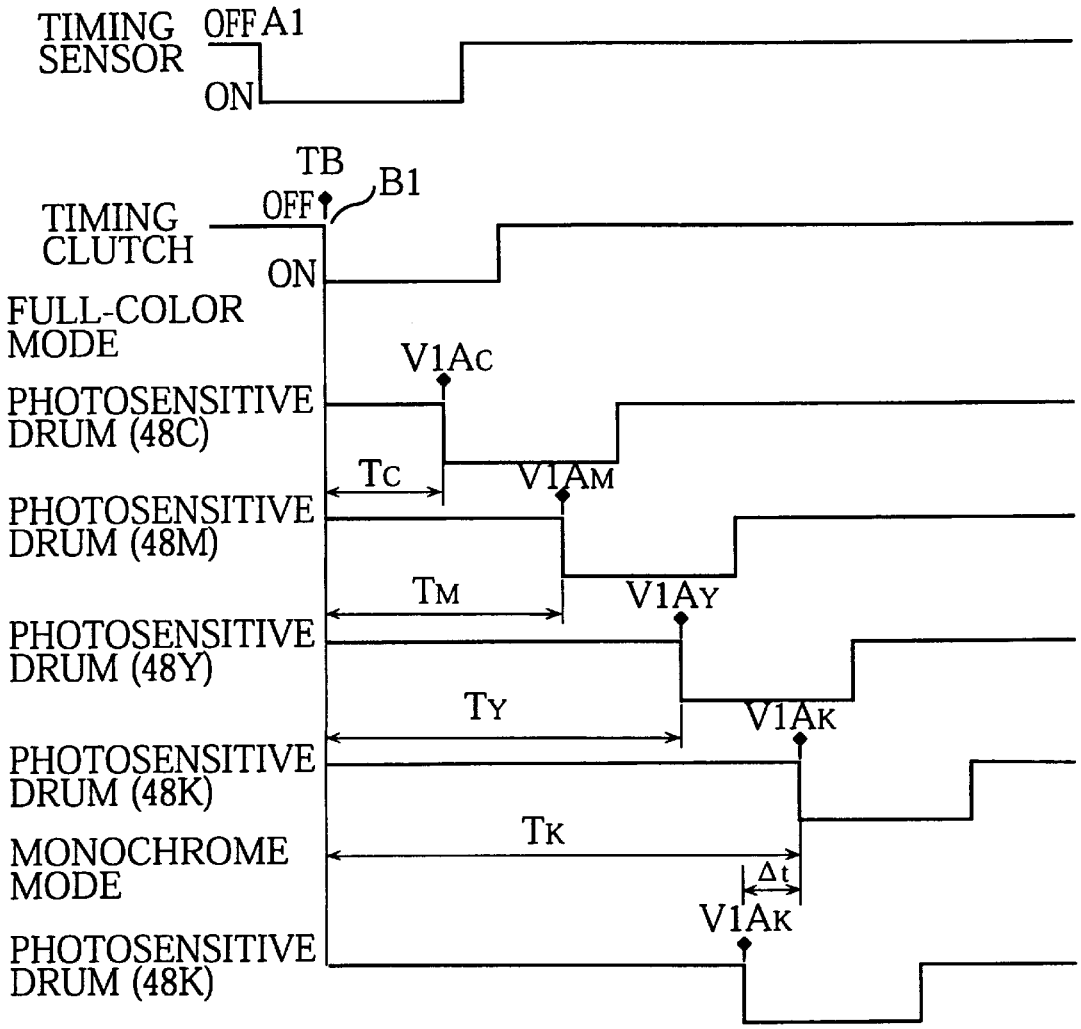
FIG. 15 is a timing chart of exposure starting timing for each photosensitive drum of the digital full-color copying machine.

Next, the exposure start control of the photosensitive drums 48C to 48K is explained, with reference to the timing chart of FIG. 15.

The leading edge of a recording sheet supplied from the paper cassette 42 is detected by the timing sensor 46 (A1) and edge skew correction is performed by the pair of synchronizing rollers 45. After this, a transportation start signal TB turns ON the timing clutch (B1), and accordingly, the pair of synchronizing rollers 45 is rotated to carry the recording sheet to the transport belt 251.

In the full-color mode, signals $VIA_c$ to $VIA_k$ for starting the scanning of the photosensitive drums 48C to 48K are respectively issued when the corresponding scan waiting times Tc to Tk have elapsed from when the transportation start signal was issued.

Meanwhile, in the monochrome mode, the signal VIAk for starting the scanning of the photosensitive drum 48K is issued when the time Tk', which is Δt shorter than Tk, has elapsed.

As described above, in the image forming apparatus of the second embodiment, the transfer chargers 252C to 252K of the transfer unit 250 are fixed to the side plates 253*b* at a predetermined distance from the corresponding photosensitive drums 48C to 48K. With this construction, the entire transfer unit 250 is not shifted when the mode is changed between the full-color mode and the monochrome mode. This, as a result, gives stability to the transfer performance of the copier.

Third Embodiment

An image forming apparatus used in the third embodiment basically has the same construction as that in the second embodiment, although the construction of the transfer unit is different. Therefore, the common components are assigned the same numerals as in the second embodiment and no detailed explanation is given. The following description is focused on the different components.

Figure 16:
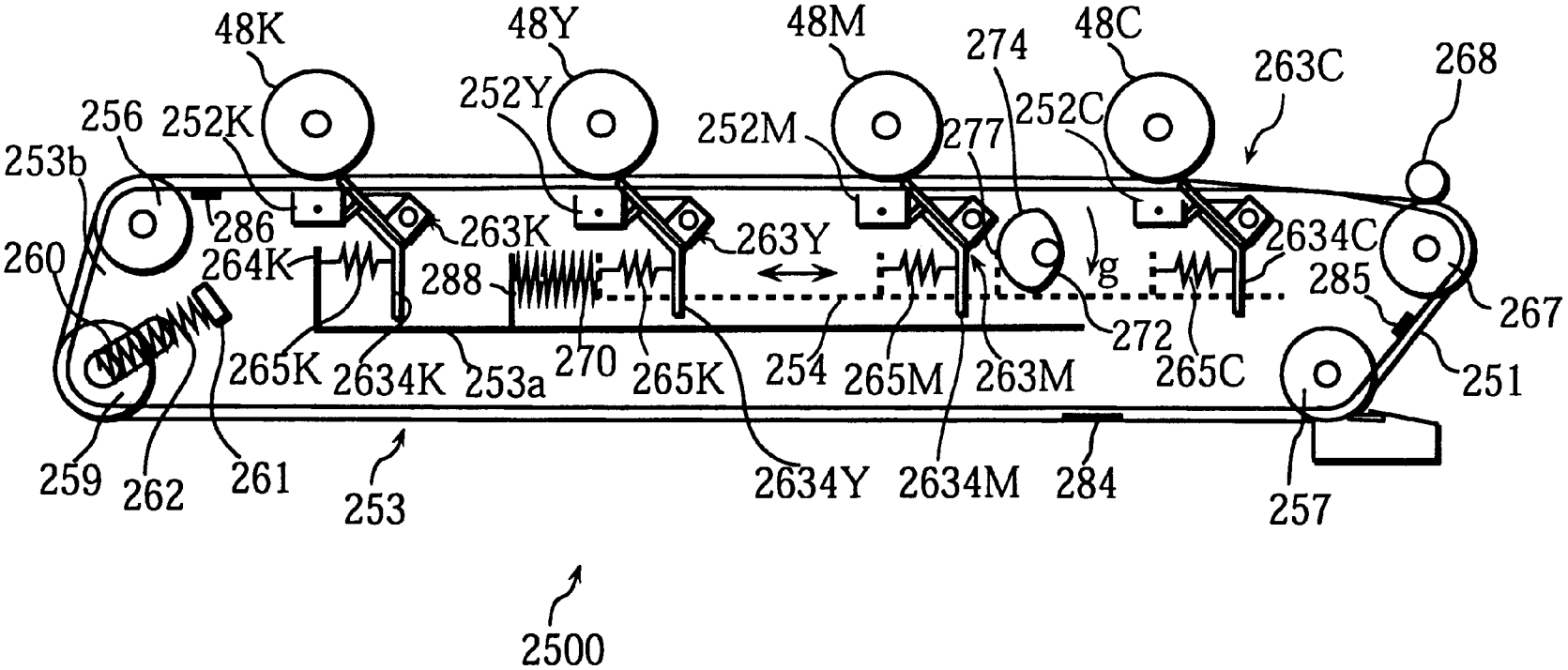
FIG. 16 is an enlarged view of the construction of a transfer unit of the digital full-color copying machine in the full-color mode in the third embodiment.

FIG. 16 shows a front view of a transfer unit 2500 used in the third embodiment. In the second embodiment, the shift roller 290 provided for the shift lever 255 shifts up and down, so that the transport belt 251 comes into contact with and separates from the photosensitive drums 48C to 48K. In the third embodiment, on the other hand, the transport belt comes into contact with and separates from the photosensitive drums due to the transfer backups. As such, the transfer unit 2500 in the third embodiment has a construction shown in FIG. 16 where the shift lever 255, the shift roller 290, and the shift cam 275 of the transfer unit 250 shown in FIG. 10 of the second embodiment are not provided. Since the transport belt comes into contact with and separates from the photosensitive drums using the transfer backups in the third embodiment, tensile springs 65C to 65K set on the transfer backups pull spring mounting units 2634C to 2634K more strongly than in the second embodiment.

The following is a description of the overall operation performed by the transfer unit 2500 when the current mode is changed in the third embodiment.

In FIG. 16, the transfer unit 2500 is in the full-color mode. More specifically, the slide frame 254 is in its leftmost position by means of the slide cam 274, and accordingly, the transport belt 251 is pushed up by the transfer backups 263C to 263K and is in contact with the four photosensitive drums 48C to 48K. The transfer backups 263C to 263K press the corresponding photosensitive drums 48C to 48K through the transport belt 251, so that an optimum nip width is secured between the transport belt 251 and the photosensitive drums 48C to 48K.

In order to change from the full-color mode to the monochrome mode, the cam driving motor 273 shown in FIG. 11 is activated. If the cam shaft 272 is judged from the detection result given by the photo sensor 276*b* shown in FIG. 11 to have rotated by 180 degrees in the direction indicated by an arrow g, in FIG. 16 the slide cam 274 will have rotated so that part of the slide cam 274 in contact with the cam follower 277 changes from the widest part to the narrowest part. Consequently, the slide frame 254 will have slid to the right due to the tension of the compressed spring 270, and the left side walls of the rectangle holes 271C to 271Y provided for the slide frame 254 as shown in FIG. 11 will be pushing the spring mounting units 2634C to 2634Y to the right. As a result, the transfer backups 263C to 263Y will have rotated counterclockwise about the mounting holes 2633C to 2633Y shown in FIG. 11, and accordingly, the backup blades 2632C to 2632Y will have been separated from the transport belt 251.

As a result, the section of the transport belt 251 between the transfer backup 263K and the drive roller 267 will have been shifted downward, and accordingly, the transport belt 251 will have been separated from the photosensitive drums 48C to 48Y, leaving a sufficient space for the recording sheet transported by the transport belt 251 to pass the photosensitive drums 48C to 48K. The transfer backup 263K always presses the transport belt 251, so that the photosensitive drum 48K and the transport belt 251 are in contact with each other aside from the case when the recording sheet needs to pass by the photosensitive drum 48K.

Figure 17:
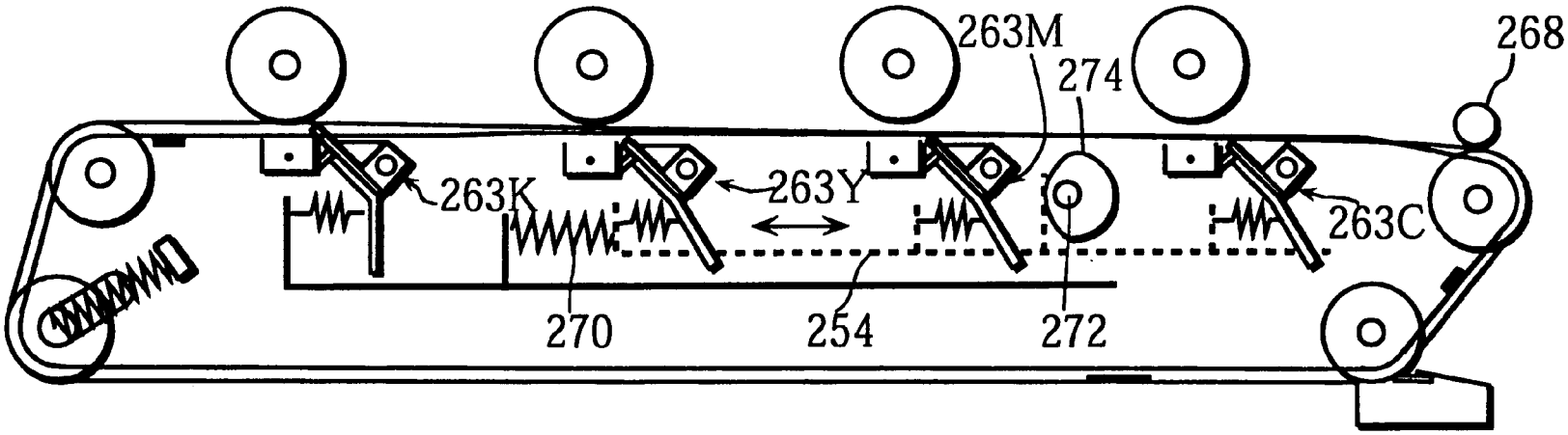
FIG. 17 is an enlarged view of the construction of the transfer unit of the digital full-color copying machine in the monochrome mode in the third embodiment.

When changing from the monochrome mode to the full-color mode, the cam shaft 272 further rotates by 180 degrees and the stated components move according to the reverse of the above operation. This is to say, the state of the transfer unit 2500 is changed from the state in FIG. 17 to the state in FIG. 16.

The processing for obtaining the mode time difference, the rotation control of the cam shaft 272, and the exposure start control of the photosensitive drums 48C to 48K are the same as in the second embodiment. Therefore, no further explanation is given.

By means of the image forming apparatus of the third embodiment as described above, the transport belt 251 comes into contact with and is separated from the photosensitive drums 48C to 48Y using the transfer backups 263C to 263Y. In addition to the effect of the image forming apparatus in the second embodiment, the construction can be simplified and the cost can be reduced.

In addition, by means of the image forming apparatuses of the second and third embodiments, the backup blades 2632C to 2632Y of the transfer backups 263C to 263Y corresponding to the photosensitive drums 48C to 48Y which are not used for image formations in the monochrome mode are separated from the transport belt 251, so that the backup blades 2632C to 2632Y do not adversely affect the running of the transport belt 251. This also prevents the deterioration of the transferred image caused by the obstructions to the running of the transport belt 251.

Moreover, by means of the image forming apparatuses of the second and third embodiments, Δt indicating the time difference between the full-color mode and the monochrome mode is detected. Here, the time difference occurs in the time period between when the feeding of a recording sheet by the pair of synchronizing rollers 45 and the recording sheet reaching a transfer position of the photosensitive drum 48K used for black image formations depending on which mode is operational. In accordance with Δt, the scan waiting time of the photosensitive drum 48K is changed, so that an image is always transferred onto the correct position on the recording sheet.

In the second and third embodiments, the transportation path length toward the photosensitive drum 48K used for black image formations in the monochrome mode is shorter than in the full-color mode, so that the scan waiting time of the photosensitive drum 48K in the monochrome mode is also shorter than in the full-color mode. It should be obvious that if the transportation path length in the monochrome mode is longer than in the full-color mode, the scan waiting time of the photosensitive drum 48K in the monochrome mode needs to be longer than in the full-color mode.

Moreover, in the second and third embodiments, once a complete copying operation has been performed, that is, when the copier is on standby, the transfer unit 250 (or, the transfer unit 2500) may return to the state of the monochrome mode shown in FIG. 12 (or, FIG. 17), regardless of the current mode. While the backup blades 2632C to 2632Y are separated from the transport belt 251, a solenoid may be provided for the transfer backup 263K. By mean s of this solenoid, the spring mounting unit 2634K may be pulled to the right, and accordingly, the transfer backup 263K may be rotated counterclockwise so that the backup blade 2632K may be also separated from the transport belt 251. If the transfer belt is pressed by the backup blade for long periods of time when not in motion, a depression may be formed at the pressed position, which can lead to discrepancies in charging characteristics at different positions on the transfer belt. This in turn can lead to deterioration in the quality of the reproduced image. Similarly, discrepancies in charging characteristics may emerge between a position on a photosensitive drum that is pressed by the transfer belt and other positions on the drum, although these problems may be avoided by providing a solenoid to withdraw the backup blade as described above.

Fourth Embodiment

Figure 18:
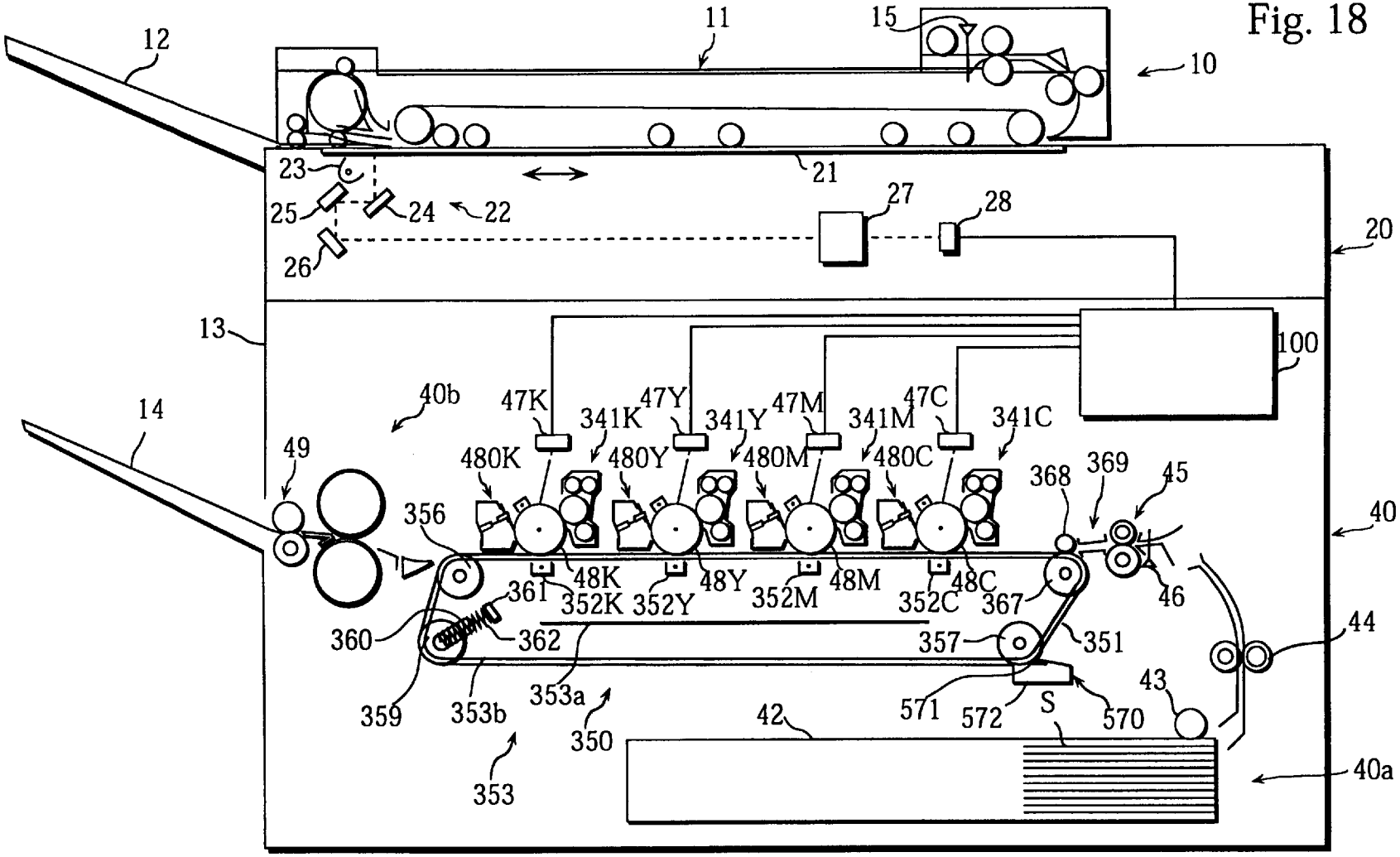
FIG. 18 shows the overall construction of a digital full-color copying machine of the fourth embodiment.

A front view of a copier used in the fourth embodiment is shown in FIG. 18.

A document detection sensor 15 is provided for the automatic document transport device 10 of the copier used in the fourth embodiment for detecting whether a document is set on the document supplying tray 11.

The copier of the fourth embodiment is basically the same as that of the first embodiment, except for the different constructions of the transfer unit and drum cleaners 480C to 480K including the cleaning blades, and for certain control operations of the control unit and the CPU. Therefore, the explanation of the common components is omitted and the following description is focused on the different components.

The transfer unit 350 is explained first. The transfer unit 350 is composed of a frame 353 which is formed of a base plate 353*a* that has a predetermined width (parallel to the viewing direction in FIG. 18) and side plates 353*b* that are provided on the front side and the rear side of the base plate 353*a* (as the copier is viewed in FIG. 18). Rotation axes of slave rollers 356 and 357, a tension roller 359, and a drive roller 367 are set to freely rotate at the positions on the side plates 353*b* shown in FIG. 18 via respective bearings (not illustrated). The bearings of the tension roller 359 are held in rounded rectangular holes 360 which longitudinally extend upward and to the right, with the axis of the tension roller 359 passing through the holes 360. The bearings are held by the tension of compressed springs 362 which are set between the bearings and spring mounting elements 361 that are set on the side plates 353*b* and protrude outward. The tension roller 359 keeps the tension of a transport belt 351 constant. A motor (not illustrated) for driving the drive roller 367 is fixed to one of the side plates 353*b,* with an output axis of the motor and the rotation axis of the drive roller 367 being coupled.

A charging roller 368 for pressing the surface of the drive roller 367 rotates together with the drive roller 367, with the transport belt 351 running between these rollers. In addition, the charging roller 368 serves as a charger which charges a recording sheet fed by the pair of synchronizing rollers 45, so that the recording sheet is securely attracted to the transport belt 351. It should be noted here that a separating charger is set on the left (as viewed in FIG. 18) of the photosensitive drum 48K. By means of this separating charger, the recording sheet with the transferred toner images is separated from the transport belt 351. A belt cleaner 570 is set facing the slave roller 357. The belt cleaner 570 mechanically scrapes off dust, such as toner, remaining on the surface of the transport belt 351 after an image transfer, using a cleaning blade 571 that presses the slave roller 357 via the transport belt 351. The scraped-off toner falls into a box 572. A guiding component 369 for guiding a recording sheet is set between the pair of synchronizing rollers 45 and the drive roller 367 via a mounting component (not illustrated) set on the side plates 353*b* of the main frame 353.

Transfer chargers 352C to 352K are set between the side plates 253*b* of the main frame 253, and are each located directly under a different one of the photosensitive drums 48C to 48K at a certain distance from the photosensitive drums 48C to 48K.

The toner images formed on the photosensitive drums 48C to 48K are sequentially transferred onto a recording sheet S transported by the transport belt 351 at respective transfer positions located under the photosensitive drums 48C to 48K with electrostatic power of the transfer chargers 352C to 352K. The recording sheet S on which a toner image is transferred is transported by the transport belt 351 to the fixing unit 40*b*, where toner particles on the recording sheet S is fused and fixed in place. The recording sheet is then discharged onto the tray 14 via the pair of discharge rollers 49.

In reality, toner particles forming a toner image on the photosensitive drums 48C to 48K are not completely transferred on a recording sheet, and a small number of toner particles remain on the photosensitive drums 48C to 48K. The drum cleaners 480C to 480K for scraping off the remaining toner are provided for the corresponding photosensitive drums 48C to 48K, so that the remaining toner will not affect the next image formation. The drum cleaners 480C to 480K have the same construction. As one example, the following description is only for the drum cleaner 480K provided for the photosensitive drum 48K.

Figure 19:
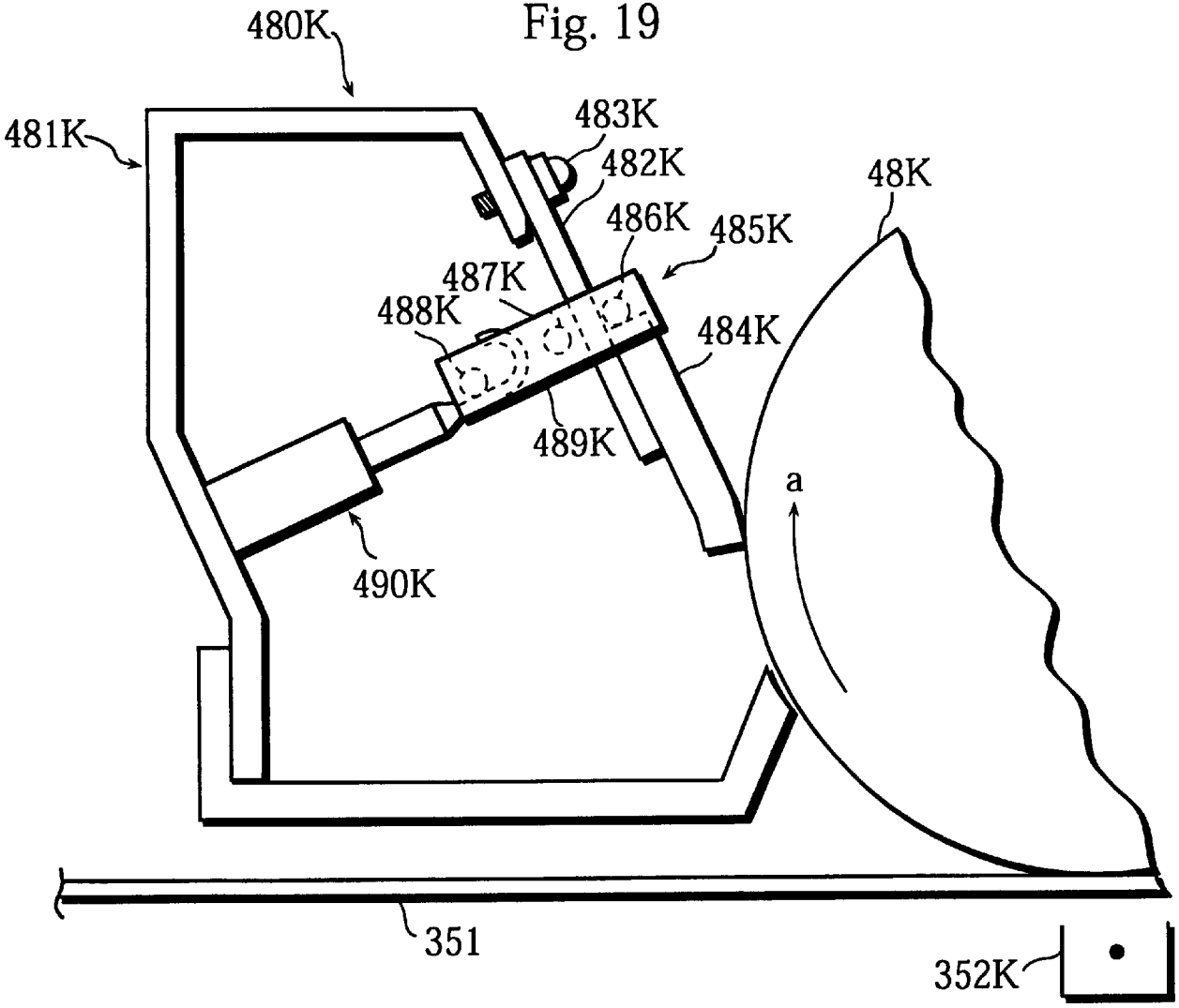
FIG. 19 is an enlarged view of the schematic construction of a drum cleaner of the digital full-color copying machine in the fourth embodiment, with a cleaning blade being pressed against a photosensitive drum.

FIG. 19 shows the construction of the drum cleaner 480K. The drum cleaner 480K is composed of a toner collecting box 481K, with side plates (not illustrated) being set on the front side and the rear side. Only the part of the toner collecting box 481K which faces the photosensitive drum 48K is open. FIG. 19 shows a front view where the front side plate (as the copier is viewed in FIG. 19) is removed. A plate spring 482K is longitudinally mounted with a plurality of screws 483K on the upper position of the opening. A cleaning blade 484K is mounted on the plate spring 482K, with one edge of the cleaning blade 484K is pressed against the surface of the photosensitive drum 48K by the tension of the plate spring 482K. As the photosensitive drum 48K rotates in the direction indicated by the arrow h in FIG. 19, the cleaning blade 484K scrapes off the toner, which is remaining on the surface of the photosensitive drum 48K without having not been transferred onto the recording sheet, and collects the scraped toner in the toner collecting box 481K. This method using a cleaning blade is often used because of the high performance of the toner scraping and its simple construction as compared with other methods.

A towing component 485K is mounted on the plate spring 482K. The towing component 485K is composed of three bar components 486K, 487K, and 488K and two plate components 489K. The bar components 486K, 487K, and 488K, which are circular in cross section, are set in parallel, with both ends of the three bars being mounted on the plate components 489K. Out of the two plates, the plate component 489K of the front side is shown in FIG. 19. The plate spring 482k is set to pass between the bar components 486K and 487K. A solenoid 490K is set on the inside wall facing the opening of the toner collecting box 481K, with the setting position roughly being on the center of the inside wall. The tip of the solenoid 490K is provided with a hook-shaped plunger. In FIG. 19, the plunger is at its uppermost position. When the plunger moves backward from this position, the plunger hooks the bar component 488K of the towing component 485K and pulls toward the inside the toner cleaning box 481K. The plate spring 482K is accordingly pulled toward the solenoid 490K. As a result, the cleaning blade 484K is separated from the photosensitive drum 48K.

Figure 20:
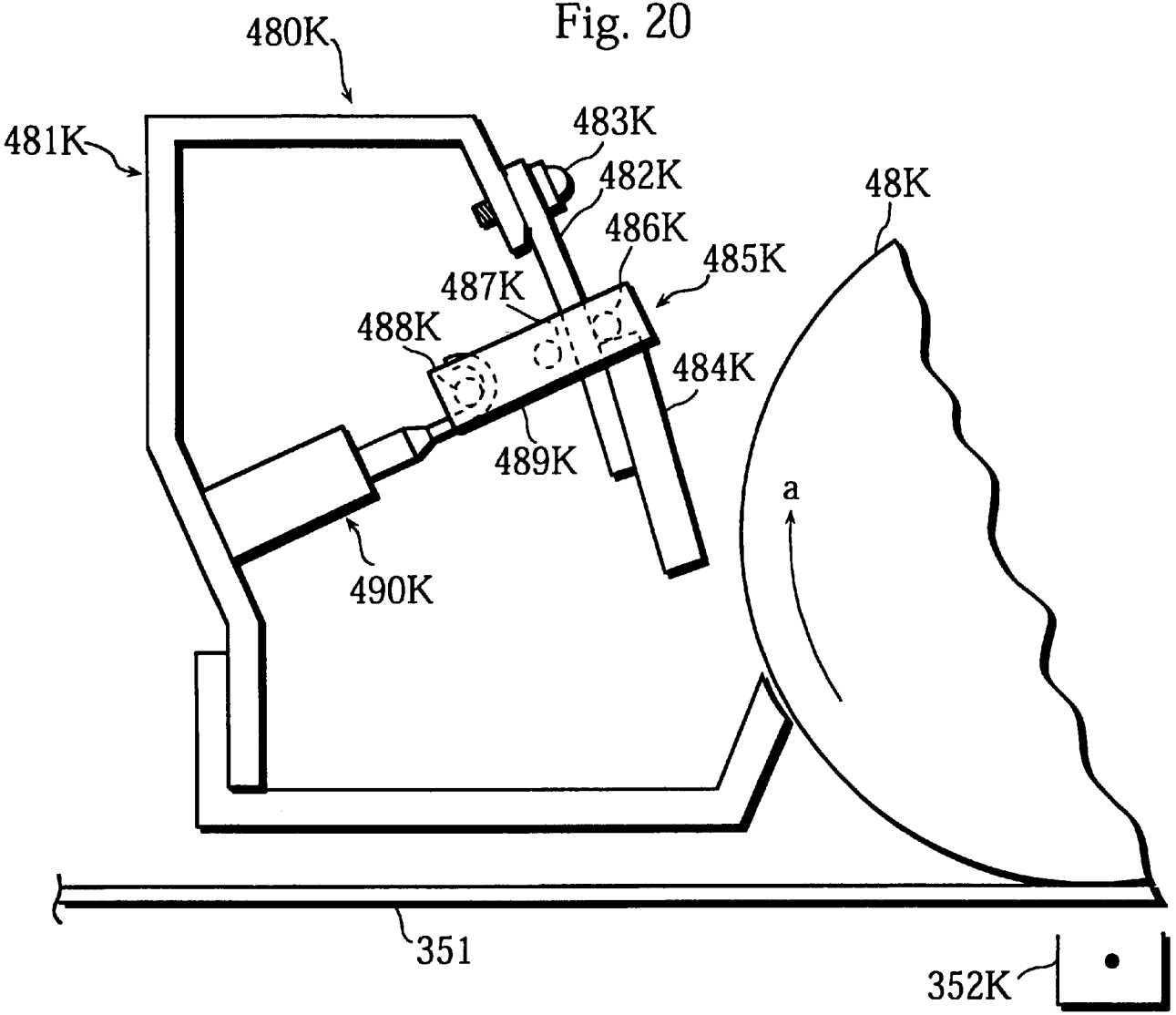
FIG. 20 is an enlarged view of the schematic construction of a drum cleaner of the digital full-color copying machine, with the cleaning blade being separated from the photosensitive drum.

In FIG. 20, the plunger of the solenoid 490K is at its rearmost position and the cleaning blade 484K is separated from the photosensitive drum 48K. Back and forth movement of the plunger of the solenoid 490K is performed in accordance with an instruction from a control unit 100 described later. A plunger of a solenoid provided for a photosensitive drum which is not used for an image formation is separated from the photosensitive drum. Since the recording sheet sequentially comes into contact with the four photosensitive drums when being transported by the transport belt 351, even a photosensitive drum which is not used for the image formation has to rotate. However, as described above, unnecessary wear and tear of the photosensitive drum and the cleaning blade can be prevented by separating the cleaning blade from the photosensitive drum.

Figure 21:
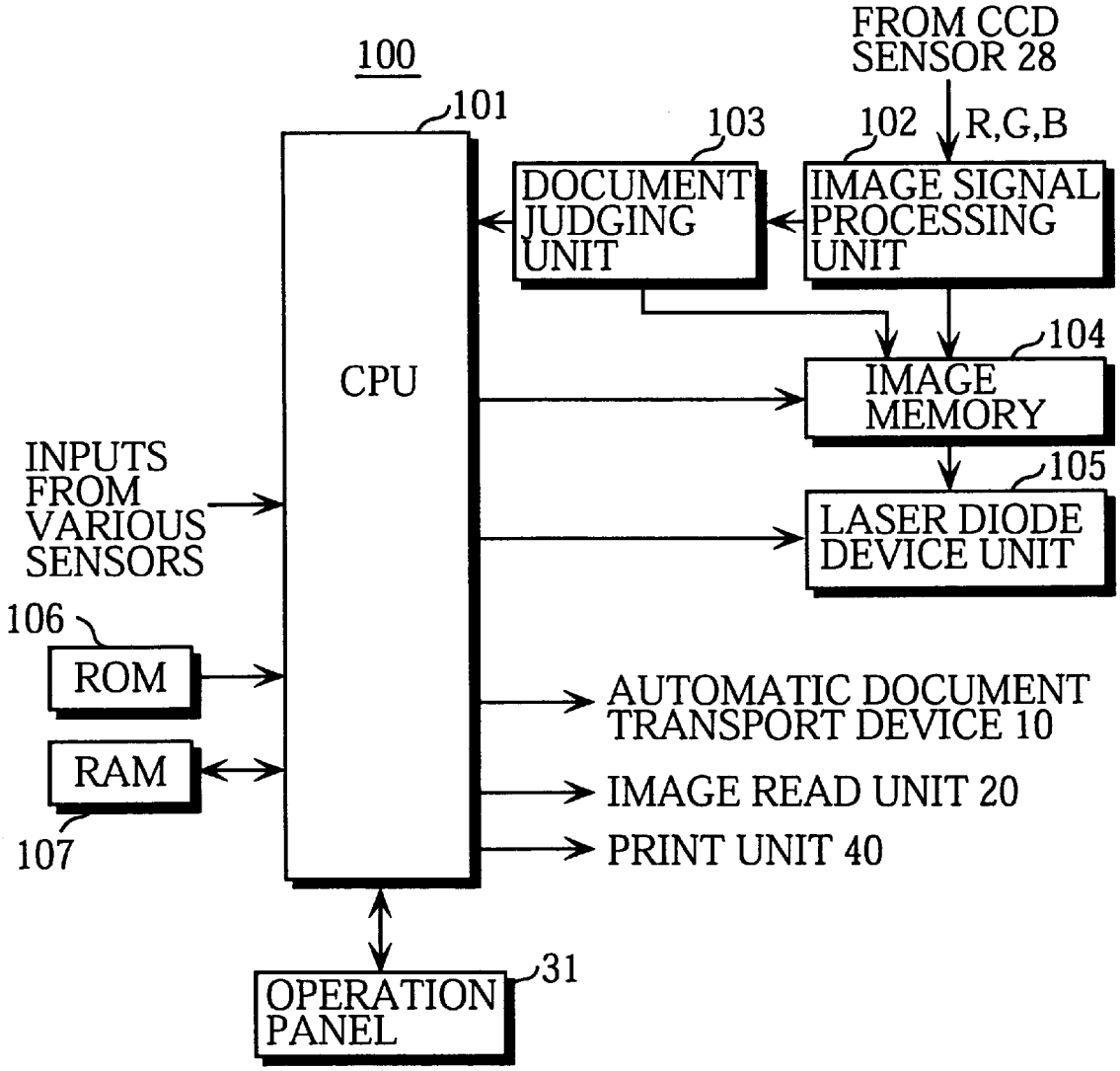
FIG. 21 is a block diagram showing the construction of a control unit of the digital full-color copying machine.

The operation panel 31 shown in FIG. 21 is provided on the optimum position on the top of the copier. This operation panel 31 is the same as the operation panel 31 of the first embodiment, and therefore, the explanation is omitted.

Figure 22:
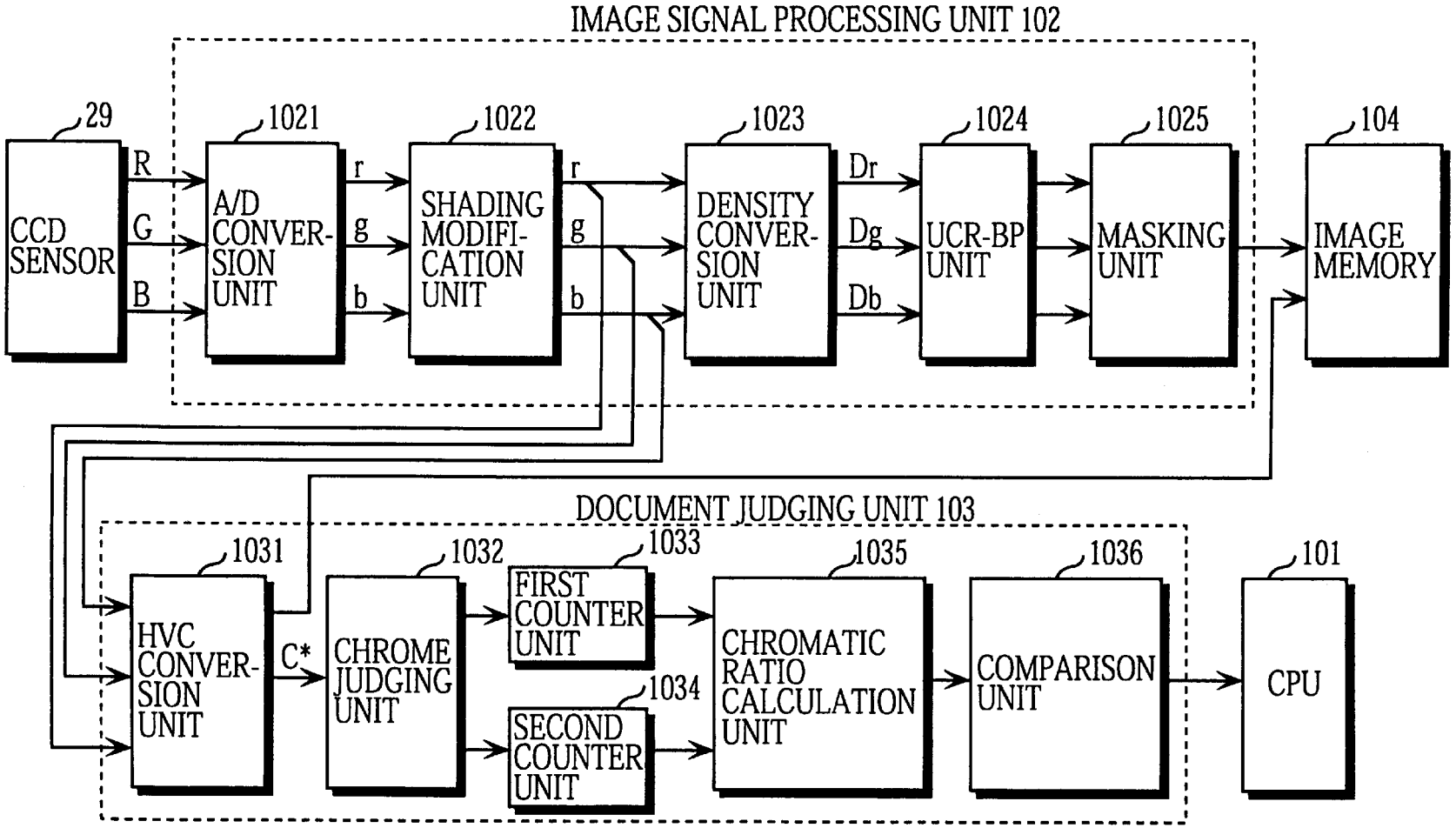
FIG. 22 is a block diagram showing the detailed constructions of an image signal processing unit and a document judging unit of the control unit.

FIG. 21 is a block diagram showing the construction of the control unit 100 provided in the copier. FIG. 22 is a block diagram showing the constructions of the image signal processing unit 102 and the document judging unit 103 of the control unit 100.

The control unit 100 is basically the same as that explained with reference to FIGS. 6 and 7 in the first embodiment. Therefore, the following description is focused on the different components.

As shown in FIG. 21, the document judging unit 103 judges whether each document is color or monochrome by performing data processing on the image data of the documents transmitted from the image signal processing unit 102, and sends the judgement results to the CPU 101. Also, the document judging unit 103 sends Value data of the image, which is obtained halfway through the data processing, as the image data to the image memory 104.

Meanwhile, the image data R, G, and B sent from the shading modification unit 1022 to the HVC conversion unit 1031 in the document judging unit 103 is converted into data for Hue angle (H*), Value (V) and Chroma (C*) of the color area signal in the uniform color space of the Munsell color system in accordance with predetermined conversion equations. Of the data, the Value (V) data is sequentially sent to the image memory 104 as density data and stored for each page. This density data is used for single-color copying.

A table 1060 shown in FIG. 23 is stored in the ROM 106. The table 1060 shows combinations of the photosensitive drums which are to be used and not to be used for an image formation corresponding to indications made using a full-color mode key and color specify keys on the operation panel 31 and to the judgement result given by the document judging unit 103.

The RAM 107 has respective blade contact/separate flags corresponding to the drum cleaners 480C to 480K. The blade contact/separate flag indicates whether the cleaning blade is in contact with or separated from the photosensitive drum. If the flag is "0", this means that the cleaning blade pressed tightly against the photosensitive drum, that is, the plunger of the solenoid is at its uppermost position. If the flag is "1", this means that the cleaning blade is separated from the photosensitive drum, i.e., the plunger of the solenoid is at its rearmost position.

When the full-color mode key or one of the color specify keys on the operation panel 31 is pressed, the CPU 101 controls the solenoids 490C to 490K of the drum cleaners 480C to 480K in accordance with the pressed key, so that the cleaning blades 484C to 484K come into contact with or separate from the corresponding photosensitive drums 48C to 48K. In the same way, when the auto color mode key is pressed, the CPU 101 controls the solenoids 490C to 490K of the drum cleaners 480C to 480K in accordance with the judgement result given by the document judging unit 103, so that the cleaning blades 484C to 484K come into contact with or separate from the corresponding photosensitive drums 48C to 48K.

Figure 24:
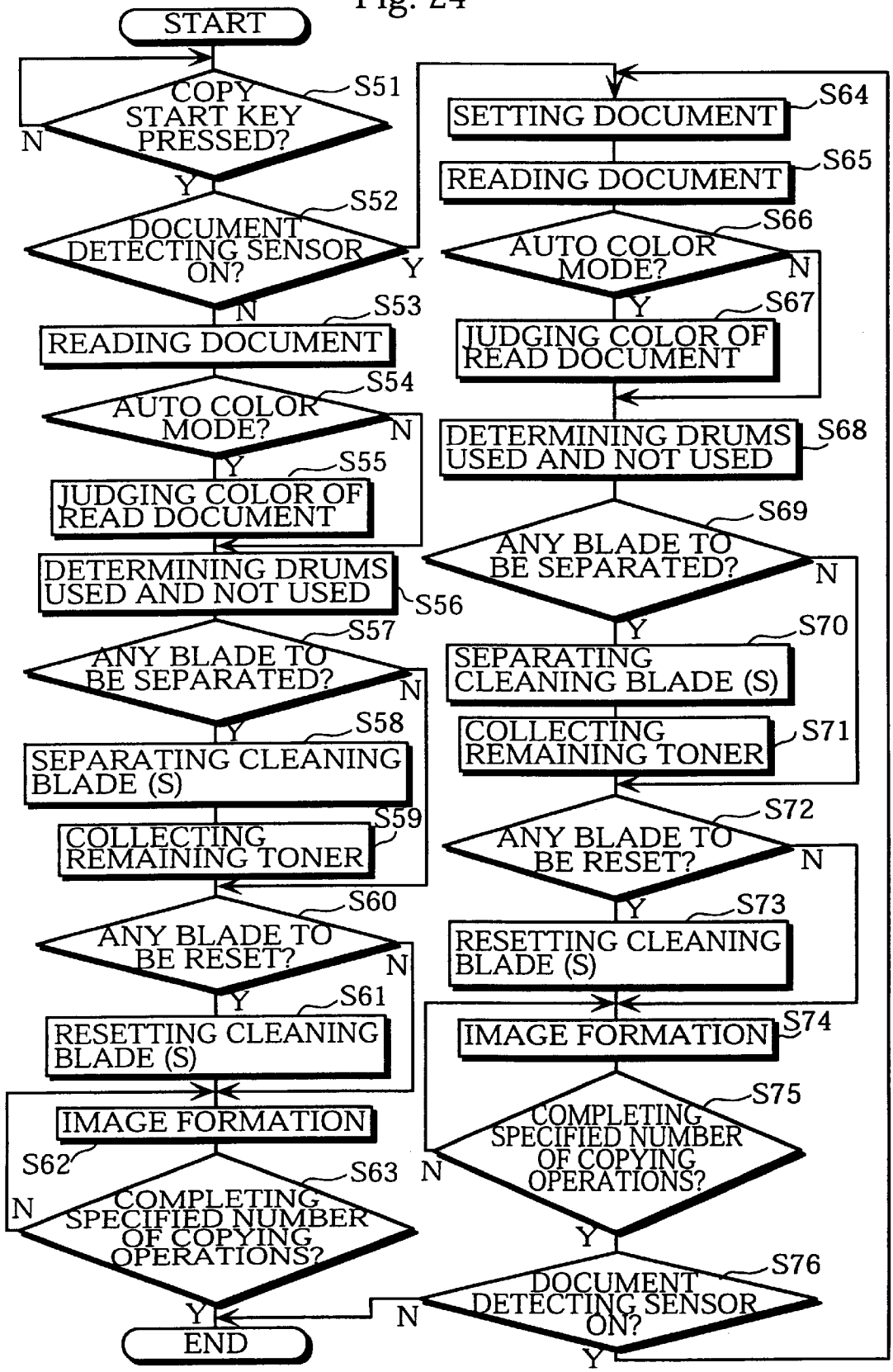
FIG. 24 is a flowchart showing the contact/separate control of the cleaning blade.

Next, the contact/separate control of the cleaning blade (in other words, back and forth control of the plunger of the solenoid) is explained, with reference to the flowchart of FIG. 24.

When the copy start key is pressed ("Yes" in step S51), the CPU 101 judges whether the automatic document transport device 10 is to be used, in accordance with the detection result given by the document detection sensor 15 (step S52). If the document detection sensor 15 is not currently turned ON ("No" in step S52), the CPU 101 judges that the automatic document transport device 10 is not to be used and controls the image read unit 20 to read a document set on the platen glass 21 (step S53).

After this, the CPU 101 judges whether the auto color mode is selected (step S54). If so ("Yes" in step S54), the CPU 101 obtains the detection result from the document judging unit 103 as to whether the read document is color or monochrome (step S55). The CPU 101 then determines each photosensitive drum which is to be used by referring to the table 1060 (step S56). On the other hand, if the auto color mode is not selected in step S54 ("No" in step S54), the CPU 101 determines each photosensitive drum which is to be used by referring to the table 1060 in accordance with a pressed key, i.e., either a full-color mode key or one of the color specify keys (step S56).

Following this, the CPU 101 judges whether each cleaning blade of each photosensitive drum judged as "not used" should be separated from the corresponding photosensitive drum(s) by referring to the blade contact/separate flag(s) (step S57). More specifically, if the photosensitive drum is judged as "not used" and the blade contact/separate flag is set at "0", the CPU 101 judges that the cleaning blade is to be separated from the corresponding photosensitive drum. Here, if a photosensitive drum is judged as "not used" and the blade contact/separate flag is set at "1", the cleaning blade is already separated from the photosensitive drum, so that the CPU 101 judges that the cleaning blade is not to be moved.

The CPU 101 separates each cleaning blade judged to be separated from the corresponding photosensitive drum and sets each blade contact/separate flag at "1" (step S58). Then, the CPU 101 proceeds to step S59.

In step S59, remaining toner on each photosensitive drum from which the cleaning blade is separated in step S58 is scraped off. When the cleaning blade 484K is tightly pressed against the photosensitive drum 48K as shown in FIG. 19, some of the toner that gathers on the cleaning blade 484K will remain to form a line on the photosensitive drum 48K even after the cleaning blade has been separated from the photosensitive drum 48K. In the present embodiment, the photosensitive drums which are not used for an image formation also rotate, and as a result, the remaining toner in the string form can stain the recording sheet transported by the transport belt 351 as the photosensitive drums rotate. For this backdrop, the toner remaining on the photosensitive drum is scraped off and collected before the recording sheet reaches the transfer position under the photosensitive drum for the first image formation after the separation of the cleaning blade. The following is a description of this toner scraping/collecting method, with reference to FIG. 18.

The CPU 101 has the four photosensitive drums 48C to 48K rotate and the transport belt 351 rotate. Simultaneously, the CPU 101 activates the transfer charger corresponding to the photosensitive drum from which the cleaning blade has just separated, and has the remaining toner transferred onto the transport belt 351 so that the remaining toner is removed from the surface of the photosensitive drum. The remaining toner transferred onto the transport belt 351 is removed and collected by the belt cleaner 570. By removing the remaining toner on the photosensitive drum and collecting before the first use of the photosensitive drum after the separation of the cleaning blade in this way, adverse effects on a next image formation caused by remaining toner can be prevented beforehand.

In FIG. 24, when the collecting of the remaining toner is completed (step S59), the CPU 101 judges whether each cleaning blade of each photosensitive drum which is determined as "used" in step S56 should be reset, that is, should be tightly pressed against the photosensitive drum, by referring to the blade contact/separate flag (step S60). More specifically, if a photosensitive drum is judged as "used" and the blade contact/separate flag is set at "1", the CPU 101 judges that the cleaning blade is to be reset. Here, when the photosensitive drum is judged as "used" and the blade contact/separate flag is set at "0", the cleaning blade is tightly pressed against the photosensitive drum already, so that the CPU 101 does not need to reset the cleaning blade.

Following this, the CPU 101 resets each cleaning blade which is to be reset as well as setting the blade contact/separate flag at "0" (step S58). The CPU 101 then performs the specified number of image formations, with the number being specified using the operation panel 31 to complete the processing (steps S62 and S63).

If the document detection sensor 15 is currently turned ON in step S52, the CPU 101 judges that the automatic document transport device 10 is to be used and so controls the automatic document transport device 10 to sequentially feed the documents set on the document supplying tray 11 to the platen glass 21 of the image read unit 20 (step S64). Then, the CPU 101 performs processing from step S65 to step S75 on the document set on the platen glass 21. After completing the processing from step S65 to step S75 on the all documents set on the platen glass 21 (No in step S76), the overall processing is terminated. It should be noted here that the processing from step S65 to step S75 is the same as the processing from S53 to step S63, and therefore will not be explained.

By means of the image forming apparatus of the present embodiment described above, all the photosensitive drums rotate regardless of whether they are being used or not used for an image formation, so that a recording sheet is smoothly transported on the transportation path. Here, the cleaning blade of each photosensitive drum which is not used for the image formation is separated from the photosensitive drum. As a result, unnecessary wear and tear of the photosensitive drum and the cleaning blade is prevented, so that the lifespans of the photosensitive drums and the cleaning blades are increased.

In a conventional image forming apparatus, wear and tear of the photosensitive drums of cyan, magenta, and yellow is prevented only in the monochrome image formation. On the other hand, by means of the image forming apparatus of the present embodiment, wear and tear of any photosensitive drum which is not used for the image formation in any single-color image formation is prevented. Accordingly, the lifespans of the photosensitive drums and the like provided in the present image forming apparatus can be further increased, compared with those provided in the conventional image forming apparatus.

In the present embodiment, although toner remaining on the surfaces of the photosensitive drums after the separation of the cleaning blades is transferred onto the transport belt and then scraped off, the removal method is not limited to this. The following methods may be used, for example.

Figure 25:
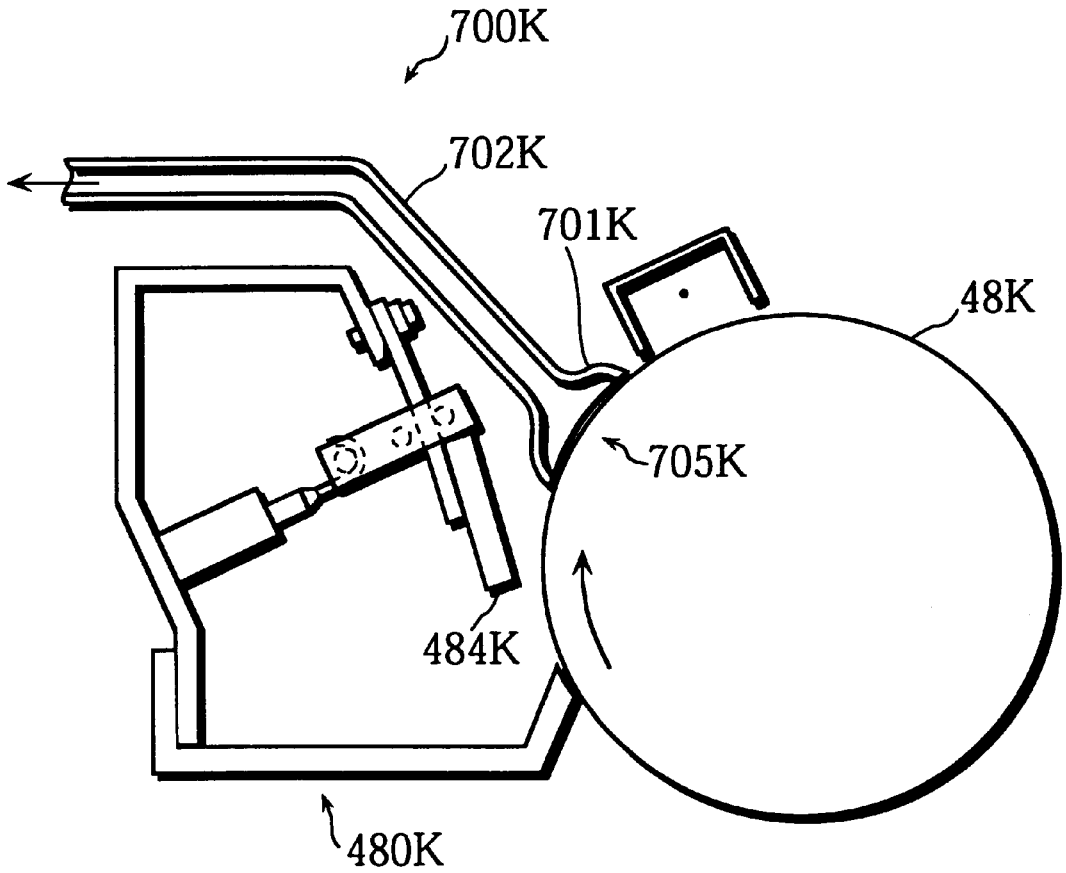
FIG. 25 shows the schematic construction of a vacuum device for vacuuming remaining toner in the digital full-color copying machine.
Figure 25:
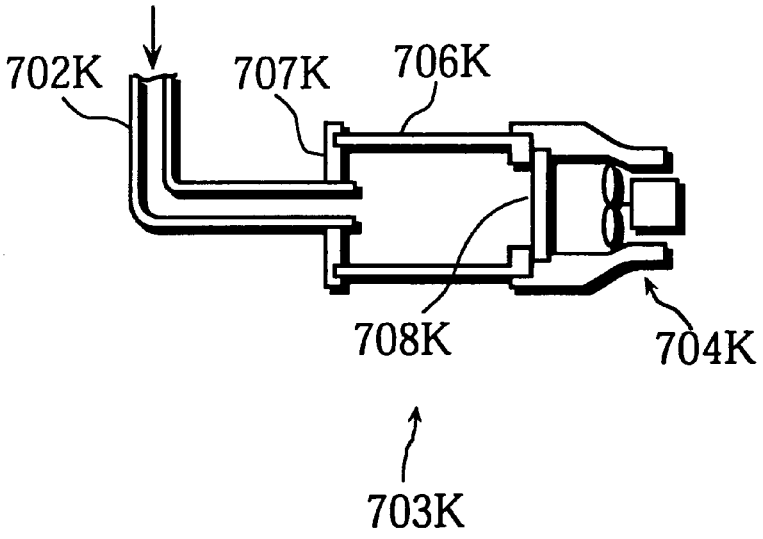

FIG. 25 is a method example using a vacuum device. The vacuum device is respectively provided for image forming units 341C to 341K. All the vacuum devices have the same construction, and therefore, only a vacuum device 700K of the image forming unit 341K is explained.

The vacuum device 700K is composed of a vacuum orifice 701K, a pipe 702K, a toner collecting box 703K, and a blower motor 704K. The vacuum orifice 701K has a predetermined width along the surface of the photosensitive drum 48K and is composed of an opening 705K which extends from one end of the photosensitive drum 48K to the other. The opening 705K is set between the cleaning blade 484K and a sensitizing charger, at a certain distance from the surface of the photosensitive drum 48K. The pipe 702K is circular in cross section, with one end being connected to the central part of the vacuum orifice 701K and the other end to the toner collecting box 703K. The toner collecting box 703K is composed of a cylinder unit 706K. A lid 707K is set on one end of the cylinder unit 706K and connected to the pipe 702K. The blower motor 704K is set on the other end of the cylinder unit 706K via a filter 708K. The activation and stop control of the blower motor 704K is performed-by the CPU 101.

The remaining toner collecting processing (steps S59 to S71) shown in FIG. 24 using the vacuum device 700K is explained below.

The CPU 101 has the four photosensitive drums rotate and the transport belt 351 run as well as activating the blower motor of the vacuum device of each photosensitive drum from which the cleaning blade has just separated. In the vacuum device whose blower motor is activated, the remaining toner which passes as the photosensitive drum rotates is vacuumed by the vacuum opening and collected into the toner collecting box via the pipe.

Alternatively, the remaining toner may be removed from the surface of the photosensitive drum and collected into a developing unit. In this case, the developing unit which is realized by a two-part developer method using a two-part developing agent composed of toner and a magnetic carrier is used. The magnetic carrier is magnetically attracted to a surface of a developing sleeve covering a magnetic roller and is transported as the developing sleeve rotates. Toner which is left on the photosensitive drum is attracted back to the developing carrier and is collected in the developing unit.

In the stated embodiments, the present invention is applied to a tandem-type copier which sequentially transfers each toner image formed on the photosensitive drums 48C to 48K directly onto a recording sheet. However, it should be obvious that the present invention can be applied to a tandem-type copier using an intermediate transfer method, by which each toner image formed on the photosensitive drums 48C to 48K is transferred onto a same position on a transport belt which serves as an intermediate transfer unit and then re-transferred onto a recording sheet.

Fifth Embodiment

Figure 26:
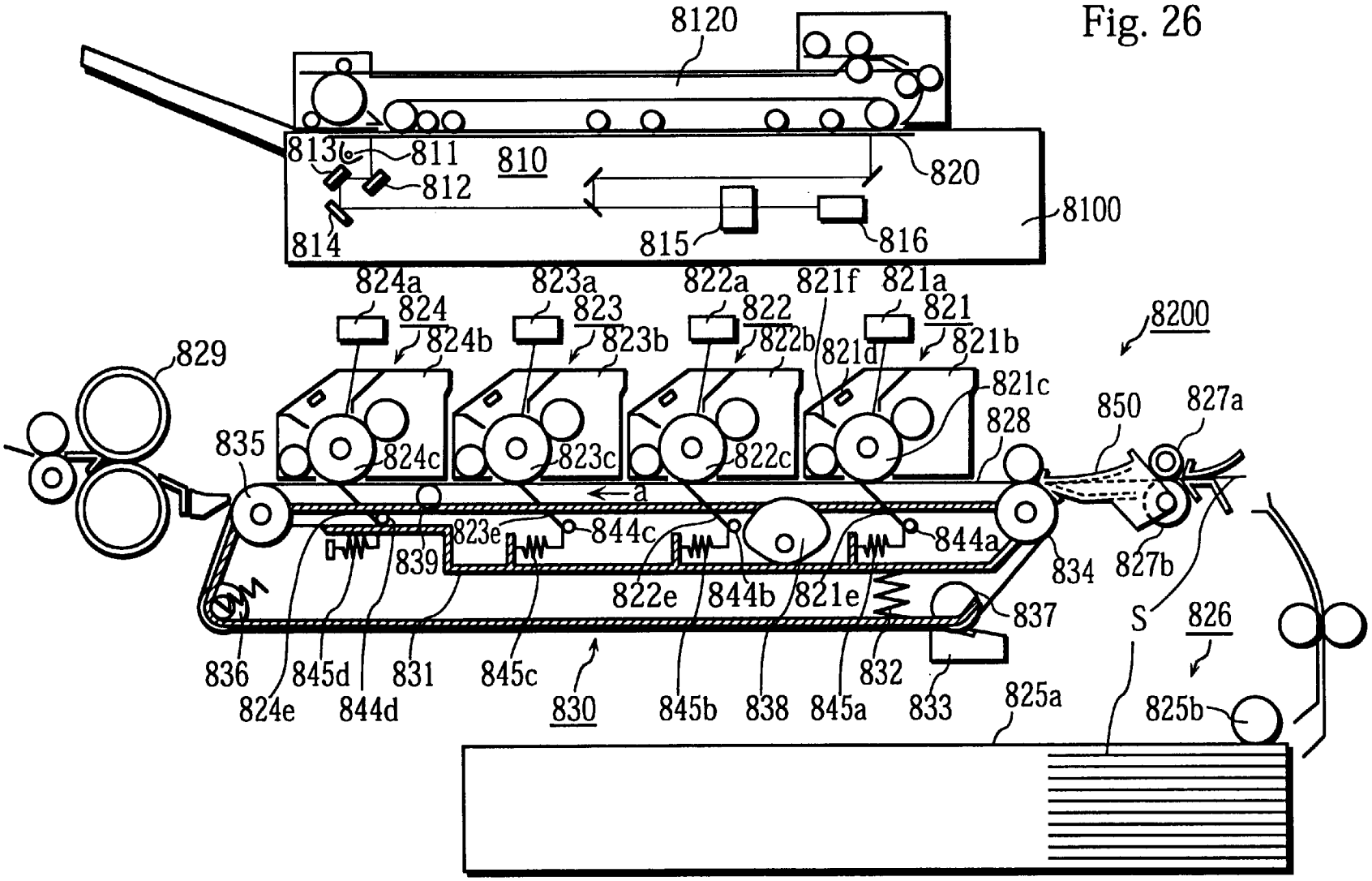
FIG. 26 shows the overall construction of a digital full-color copying machine of the fifth embodiment in the full-color mode.

The overall construction of a copier used in the fifth embodiment is shown in FIG. 26.

As shown in FIG. 26, an image read unit 8100 is provided with a scanning optical system 810 which is composed of a document setting board 820, an exposure lamp 811, mirrors 812, 813, and 814, a converging lens 815, and an image sensor 816 including a dichroic prism and a CCD sensor. The document setting board 820 is provided with an automatic document transporting device 8120 for transporting a document to a predetermined position on the document setting board 820 and for discharging the document after the exposure. This device is well known and is not especially necessary in the present embodiment.

The image sensor 816 separates an image of a color document set on the document setting board 820 into three colors, red (R), green (G), and blue (B). The image sensor 816 then has the CCD sensor read an image for each color and outputs image signals for R, G, and B.

The image signals outputted from the image sensor 816 are converted into image data of cyan (C), magenta (M), yellow (Y), and black (K) using an image signal processing circuit (not illustrated) that can be realized by a well known electronic circuit. The image data for each color is stored in an image memory. The image data stored in the image memory is read by the image signal processing circuit in a predetermined image forming timing and outputted to four image forming units 821, 822, 823, and 824 of an image processing unit 8200 described later in this specification.

The image processing unit 8200 is composed of: image forming units 821, 822, 823, and 824 corresponding to colors C, M, Y, and K; a paper supplying unit 826 including a paper supplying cassette 825*a* and a pick-up roller 825*b*; synchronizing rollers 827*a* and 827*b* set on the paper feeding part of the paper supplying unit 826; a transport belt 828 for transporting a recording sheet fed by the synchronizing rollers 827*a* and 827*b* to the image forming units 821, 822, 823, and 824; and a fixing device 829 set on the left (as the copier is viewed in FIG. 26) of the transport belt 828. The transport belt 828, which is provided in a transfer unit

830, runs at constant speed and electrostatically attracts the recording sheet to its surface to transport the recording sheet.

A guiding component 850 for guiding a recording sheet is suspended between the synchronizing rollers 827*a* and 827*b* and the transport belt 828 to stabilize the transportation of the recording sheet. The transfer unit 830 and the guiding component 850 are described in detail later in this specification.

The image forming units 821, 822, 823, and 824 are set in line above the transport belt 828 along its length, and have the same construction. As one example, the image forming unit 821 is composed of an exposure unit 821*a*, a developing unit 821*b* loading cyan toner, a photosensitive drum 821*c* as an electrostatic latent image holding component, a sensitizing charger 821*d* for uniformly sensitizing the surface of the photosensitive drum 821*c*, and a cleaner 821*f* for removing toner remaining on the surface of the photosensitive drum 821*c*. The photosensitive drum 821*c* is set a short distance above the transport belt 828. The other image forming units 822, 823, and 824 have the same construction, although the colors of the loaded toner are different. It should be noted here that a transfer charger 821*e* for transferring a toner image formed on the photosensitive drum 821*c* onto a recording sheet is provided in a transfer unit 830 described later in this specification.

The following is a description of an image forming operation for a color image. A Laser beam emitted from the exposure unit 821*a* is modulated by the cyan image data outputted from the image signal processing circuit in the image forming unit 821. The modulated laser beam exposes the surface of the photosensitive drum 821*c*, and an electrostatic latent image is formed on the surface of the photosensitive drum 821*c*. The electrostatic latent image is developed by the developing unit 821*b*, and as a result, an image using cyan toner is formed.

Meanwhile, a recording sheet is supplied from the paper supplying unit 826. The recording sheet stops once at a nip part of the synchronizing rollers 827*a* and 827*b*. After this, the recording sheet is transported by the synchronizing rollers 827*a* and 827*b* which rotate in synchronization with the timing at which the image formed on the photosensitive drum 821*c* comes to a transfer position under the photosensitive drum 821*c*. The recording sheet is transported to the transfer position, being electrostatically attracted to the transport belt 828. At the transfer position, the cyan toner image formed on the photosensitive drum 821*c* is transferred onto the recording sheet by the transfer charger 821*e*. The recording sheet on which the cyan toner image is transferred is next transported to the image forming unit 822 by the transport belt 828.

In the image forming unit 822, the laser beam emitted from the exposure unit 822*a* is modulated by the magenta image data which is outputted from the image signal processing circuit in synchronization with the timing at which the recording sheet reaches a transfer position under the image forming unit 822.

The modulated laser beam exposes the surface of the photosensitive drum 822*c*, and an electrostatic latent image formed on the surface of the photosensitive drum 822*c* is developed by the developing unit 822*b*. Accordingly, an image using magenta toner is transferred onto the recording sheet, being superimposed on the cyan toner image. The recording sheet on which the cyan and magenta toner images are superimposed is transported to the image forming unit 823 by the transport belt 828.

In the image forming unit 823, the laser beam emitted from the exposure unit 823*a* is modulated by the yellow image data which is outputted from the image signal processing circuit in synchronization with the timing at which the recording sheet on which the cyan and magenta toner images are transferred reaches a transfer position under the image forming unit 823.

The modulated laser beam exposes the surface of the photosensitive drum 823*c*, and an electrostatic latent image formed on the surface of the photosensitive drum 823*c* is developed by the developing unit 823*b*. Accordingly, an image using yellow toner is transferred onto the recording sheet, being superimposed on the cyan and magenta superimposed toner image. The recording sheet on which the cyan, magenta, and yellow toner images are superimposed is transported to the image forming unit 824 by the transport belt 828.

In the image forming unit 824, the laser beam emitted from the exposure unit 824*a* is modulated by the black image data which is outputted from the image signal processing circuit in synchronization with the timing at which the recording sheet on which the cyan, magenta, and yellow toner images are transferred reaches a transfer position under the image forming unit 824. The modulated laser beam exposes the surface of the photosensitive drum 824*c*, and an electrostatic latent image formed on the surface of the photosensitive drum 824*c* is developed by the developing unit 824*b*. Accordingly, an image using black toner is transferred onto the recording sheet, being superimposed on the cyan, magenta, and yellow superimposed toner image.

The recording sheet on which the cyan, magenta, yellow, and black toner images are superimposed is transported by the transport belt 828 to a fixing unit 829, where fixing processing is performed on the recording sheet. After this, the recording sheet is finally discharged.

The following is a description of the transfer unit 830. The transfer unit 830 includes a shift unit 831 which rotates about an axis of a slave roller 835. The shift unit 831 is provided with a drive roller 834 and the slave roller 835, while the transfer unit 830 is provided with a slave roller 837 and a tension roller 836. The transport belt 828 runs between these rollers 834, 835, 836, and 837 in the direction of the arrow a shown in FIG. 26 in accordance with the rotation of the drive roller 834. A belt cleaning unit 833 for removing toner and paper dust remaining on the surface of the transport belt 828 is provided for the transfer unit 830.

Figure 27:
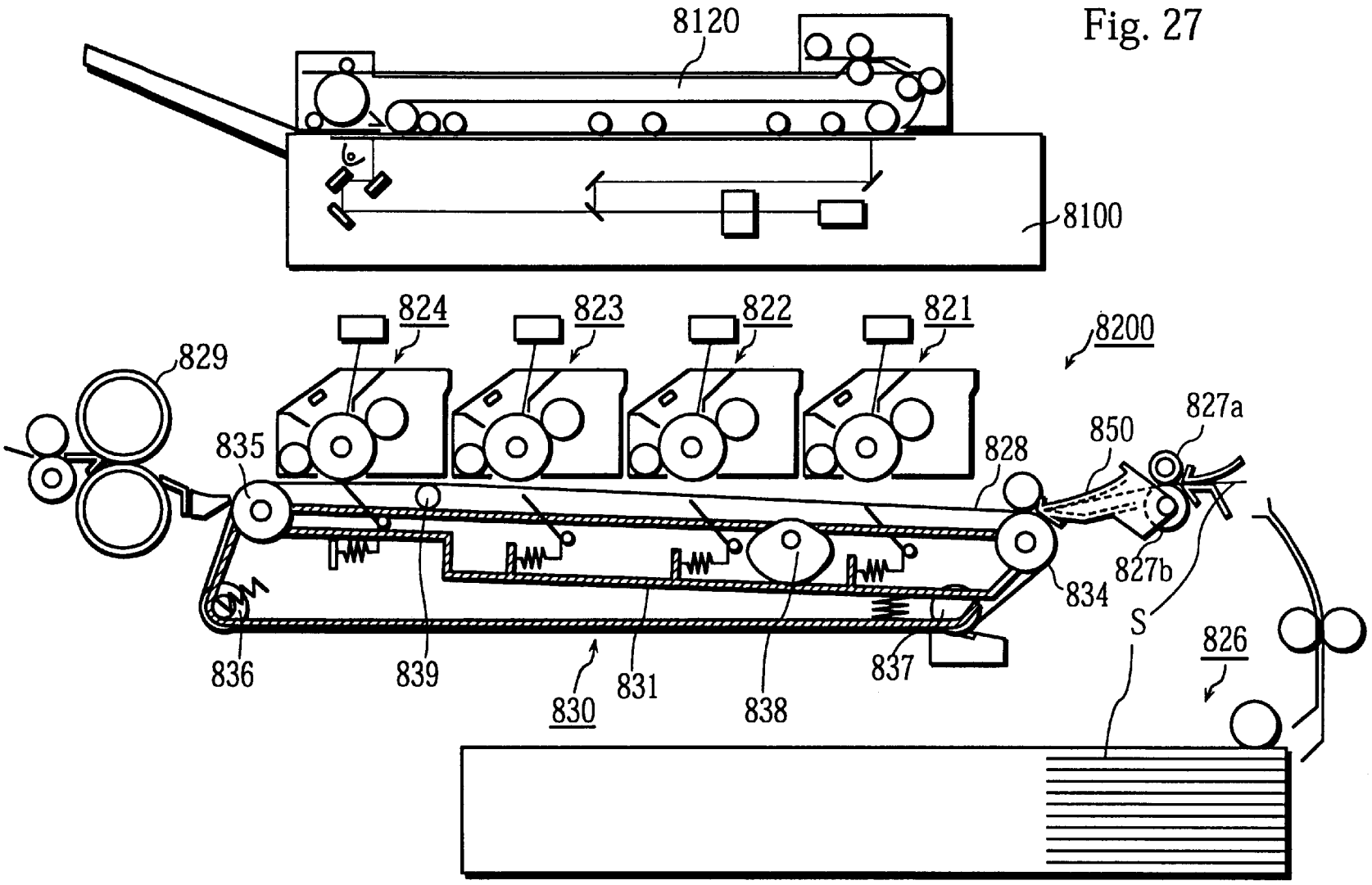
FIG. 27 shows the overall construction of the digital full-color copying machine of the fifth embodiment in the monochrome mode.

The shift unit 831 is always pressed upward by the tension of a compressed spring 832 mounted on the transfer unit 830 as shown in FIG. 26. The transfer unit 830 is also provided with a cam 838 which is driven by a cam driving motor (not illustrated), such as a stepping motor. By means of the rotation of the cam 838, the shift unit 831 can rotate about the axis of the slave roller 835 against the tension of the compressed spring 832. In FIG. 27, the shift unit 831 rotates clockwise about the axis of the slave roller 835 in accordance with the rotation of the cam 838, and the transport belt 828 is separated from the surfaces of the photosensitive drums of the image forming units 821, 822, and 823.

As shown in FIG. 26, a transfer charger 824*e* of the image forming unit 824 used for black image formations is mounted on a fulcrum 844*d* to freely rotate and is energized toward the surface of the photosensitive drum 824*c* via the tension of a spring 845*d*. Accordingly, the edge of the transfer charger 824*e* is brought close to the surface of the photosensitive drum 824*c* with the transport belt 828 in between, meaning that the correct electrical charge is given for image transfer.

It should be noted here that an assistance roller 839 is provided for the transfer unit 830, so that the transport belt 828 is not separated from the photosensitive drum 824*c* of the image forming unit 824 used for black image formations even when the shift unit 831 is shifted downward as shown in FIG. 27. This is to say, the relative positions of the transport belt 828, the surface of the photosensitive drum 824*c* and the transfer charger 824*e* are not changed, regardless of the current mode, i.e., the full-color mode or the monochrome mode.

A transfer charger 821*e* of the image forming unit 821 for cyan color, a transfer charger 822*e* of the image forming unit 822 for magenta color, and a transfer charger 823*e* of the image forming unit 823 for yellow color are also provided on the shift unit 831. As is the case with the transfer charger 824*e*, the transfer chargers 821*e*, 822*e*, and 823*e* are mounted on corresponding fulcrums 844*a*, 844*b* and 844*c* to freely rotate and energized toward the corresponding photosensitive drums 821*c*, 822*c*, and 823*c* via the tensions of corresponding springs 845*a*, 845*b*, and 845*c*. Accordingly, the edges of the transfer chargers 821*e*, 822*e*, and 823*e* are brought close to the surfaces of the photosensitive drums 821*c*, 822*c*, and 823*c* with the transport belt 828 in between, meaning that the correct electrical charges are given for image transfer.

Figure 28:
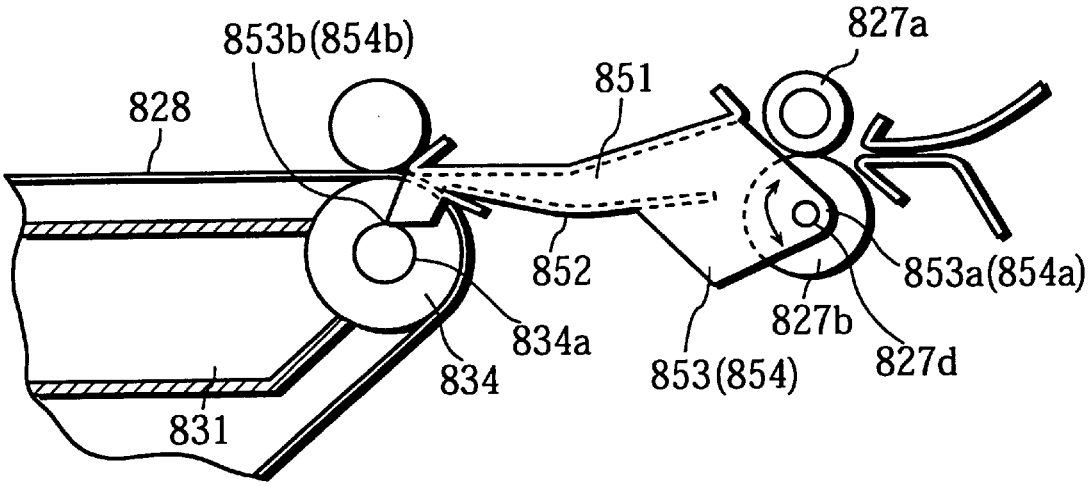
FIG. 28 shows the overall construction of a guiding component of the fifth embodiment in the full-color mode.

Next, the guiding component 850 is explained. The guiding component 850 is composed of an upper plate 851 and a lower plate 852 for catching the upperside and backside of a recording sheet S and guiding the recording sheet S in the transportation direction. The front and rear edges (as viewed in FIG. 28) of the upper plate 851 and the lower plate 852 are connected with side plates 853 and 854 at positions corresponding to the longest width of a recording sheet in the direction of the transportation. The plates 853 and 854 form a flat deformed rectangular unit through which the recording sheet S is transported. Corners 853*a* and 854*a* of the plates 853 and 854 are supported by a rotation axis 827*d* of the synchronizing roller 827*b* via parts 853*a* and 854*a* to freely rotate. Other corners 853*b* and 854*b* of the plates 853 and 854 are in loose contact with a rotation axis 834*a* of the drive roller 834.

Figure 29:
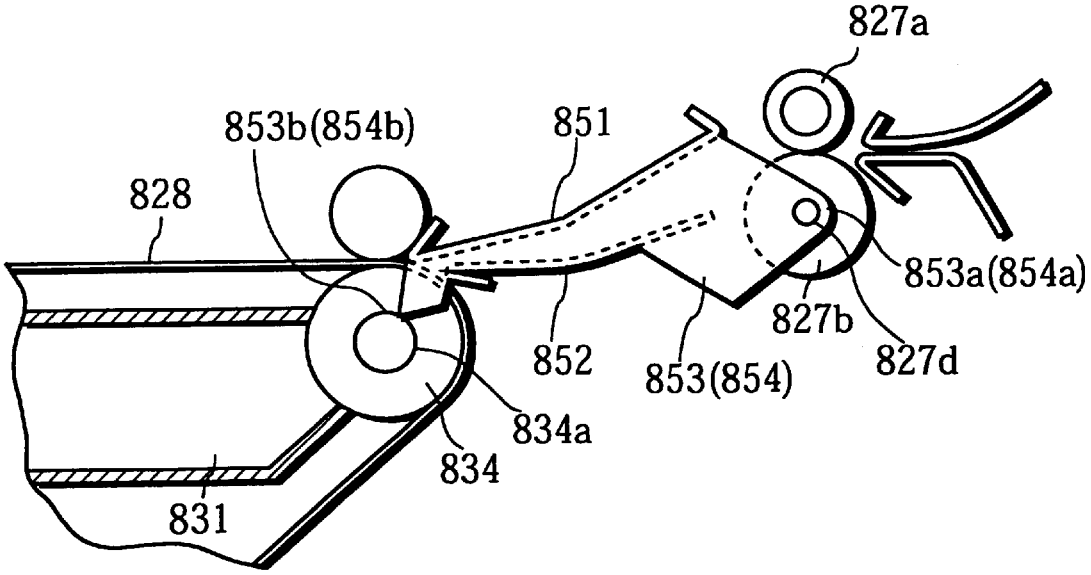
FIG. 29 shows the overall construction of the guiding component of the fifth embodiment in the monochrome mode.

When the shift unit 831 is separated from the image forming units 821, 822, and 823 and the drive roller 834 is shifted downward for a black image formation, the corners 853*b* and 854*b* of the plates 853 and 854 of the guiding unit 850 move downward under gravity, keeping contacting with the rotation axis 834*a* of the drive roller 834, as shown in FIG. 29. Accordingly, the recording sheet S is reliably transported to the transport belt 828. Here, the guiding unit 850 may be kept at the lowermost position by means of a pulling means, such as a spring, so that the recording sheet S can be transported more reliably to the transport belt 828, although this is not illustrated in FIG. 28.

In the present embodiment, the respective corners 853*a* and 854*a* of the guiding unit 850 are supported by the rotation axis 827*d* of the synchronizing roller 827*b*. However, the respective corners 853*a* and 854*a* may be supported by a rotation axis 827*c* of the synchronizing roller 827*a*, or, alternatively, may be supported by fulcrums provided as necessary.

In addition, in the present embodiment, when the drive roller 834 is shifted downward, the corners 853*b* and 854*b* of the plates 853 and 854 also move downward under gravity, keeping contacting with the rotation axis 834*a* of the drive roller 834. However, the corners 853*b* and 854*b* may be shifted by a drive means, such as a stepping motor, or a solenoid.

The image read unit 8100 has an auto color selecting function (referred to as the "ACS function" hereinafter) by which it is automatically judged whether a document set on the document setting board 820 is monochrome or color and the image forming mode is determined in accordance with the judgement result. This improves the ease-of-use of the copier and cuts the time period required for a copying operation.

Figure 30:
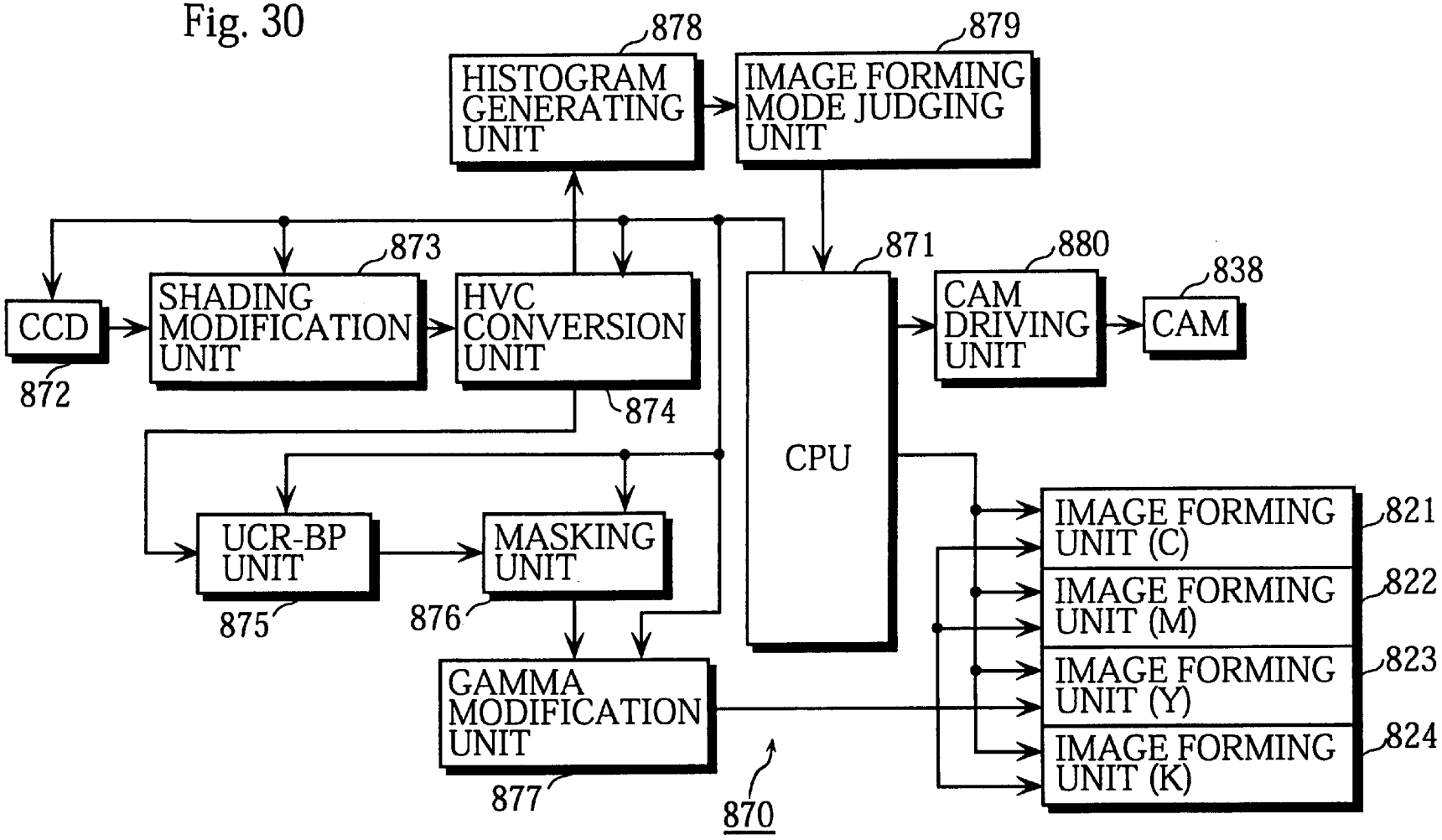
FIG. 30 is a block diagram showing a control circuit.

FIG. 30 is a block diagram showing a control circuit 870 for controlling components which mainly realize the ACS function of the image forming apparatus. The control circuit 870 is activated by a CPU 871. Shading modification is performed by the shading modification unit 873 on original color image signals (RGB signals) outputted from a CCD sensor 872 of the image sensor 816 provided in the scanning optical system 810. The shading-modified image signals are then converted into Value signals and Chroma signals in an HVC conversion unit 874 and a UCR-BP unit 875 which extract Value signals and Chroma signals, and, as a result, are converted into image data of four colors cyan (C), magenta (M), yellow (Y), and black (K). After this, predetermined modification is performed by a masking unit 876 and a gamma modification unit 877. The image data for each colors are outputted to the corresponding image forming units 821, 822, 823, and 824.

Laser beams emitted from each exposure unit of the image forming units 821, 822, 823, and 824 are modulated in accordance with the outputted signals. As a result, electrostatic latent images are formed on the photosensitive drums.

Meanwhile, the Value signal elements extracted by the HVC conversion unit 874 are inputted in a histogram generating unit 878 which generates an image histogram based on the Value elements. The histogram is outputted to an image forming mode judging unit 879, where the ratio of chromatic pixels of the document is calculated in accordance with the chromatic pixels obtained from the histogram. The image forming mode judging unit 879 then judges whether the document is color or monochrome.

If the document is judged as "color" by the image forming mode judging unit 879, the CPU 871 sets the full-color mode. The CPU 871 controls the activation of a cam driving motor 880 to rotate the cam 838 and sets the shift unit 831 of the transfer unit 830 in the state corresponding to the full-color mode as shown in FIG. 26, as well as making the image forming units 821, 822, 823, and 824 operative. If the document is judged as "monochrome", the CPU 871 sets the monochrome mode. The CPU 871 controls the activation of the cam driving motor 880 to rotate the cam 838 and sets the shift unit 831 of the transfer unit 830 in the state corresponding to the monochrome mode as shown in FIG. 27, as well as making the image forming unit 824 operative and the image forming units 821, 822, and 823 inoperative.

Figure 31:
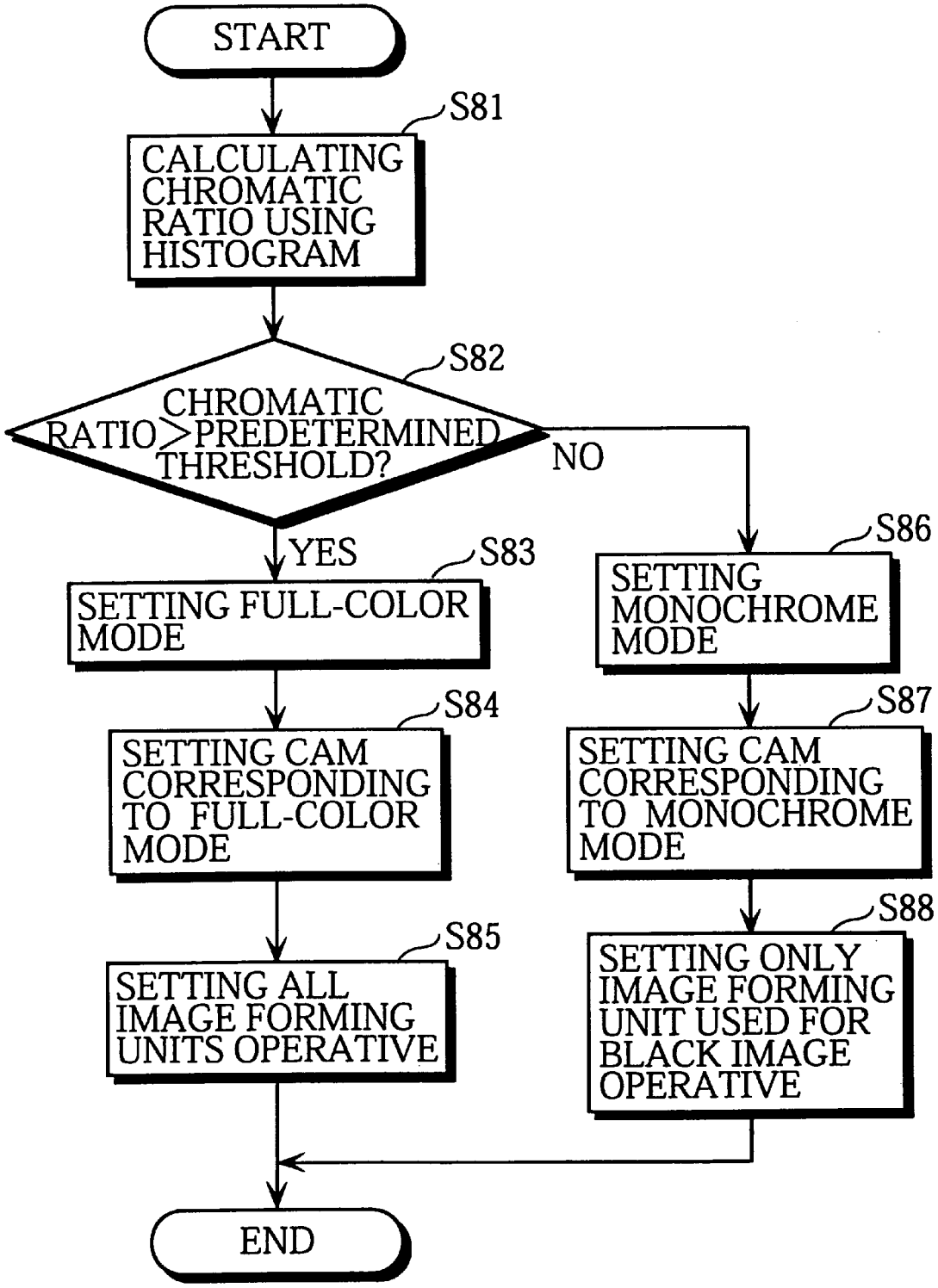
FIG. 31 is a flowchart for judging the mode to be set between the full-color mode and the monochrome mode.

FIG. 31 is a simplified flowchart showing the control operation by the control circuit 870 for judging the mode to be set between the full-color mode and the monochrome mode. The image forming mode judging unit 879 calculates the chromatic ratio of the document in accordance with the chromatic pixels obtained from the histogram (step S81), and judges whether the chromatic ratio exceeds a predetermined threshold (step S82). If so, the CPU 871 judges that the document is color and sets the full-color mode (step S83). Then, the CPU 871 has the cam 838 rotate to be positioned as in the full-color mode (step S84) as well as having the image forming units 821, 822, 823, and 824 operative (step S85).

If the chromatic ratio does not exceed the predetermined threshold, the CPU 871 judges that the document is monochrome and sets the monochrome mode (step S86). Then, the CPU 871 has the cam 838 rotate to be positioned as in the monochrome mode (step S87) as well as making the image forming unit 824 operative and the image forming units 821, 822, and 823 inoperative (step S88).

As readily understood from the stated description, when the full-color mode is set, the shift unit 831 of the transfer unit 830-is set to be positioned as in the full-color mode as shown in FIG. 26. The recording sheet S supplied from the paper supplying unit 826 passes between the synchronizing rollers 827*a* and 827*b*, and is carried toward the transport belt 828. Here, the recording sheet S carried by the synchronizing rollers 827*a* and 827*b* is guided by the guiding component 850 which is set between the synchronizing rollers 827*a* and 827*b* and the transport belt 828. The recording sheet S is attracted to the predetermined position of the transport belt 828 without bumping against the transport belt 828 or the drive roller 834 and without moving away from the predetermined position, and so is reliably transported. The recording sheet S attracted to the transport belt 828 is transported to the image forming units 821, 822, 823, and 824 in that order. Accordingly, a full-color image is formed on the recording sheet S.

Meanwhile, when the monochrome mode is set, the shift unit 831 of the transfer unit 830 is set to be positioned as in the monochrome mode as shown in FIG. 27. The recording sheet S supplied from the paper supplying unit 826 passes between the synchronizing rollers 827*a* and 827*b*, and is carried toward the transport belt 828. Here, since the shift unit 831 rotates clockwise, the right part (as viewed in FIG. 27) of the transport belt 828 is shifted lower than in the full-color mode, so that the transportation path of the recording sheet changes.

However, the recording sheet S is still guided by the guiding component 850 which is set between the synchronizing rollers 827*a* and 827*b* and the transport belt 828. Therefore, the recording sheet S is attracted to the predetermined position of the transport belt 828 without bumping against the transport belt 828 or the drive roller 834 and without moving away from the predetermined position, and is reliably transported. The recording sheet S attracted to the transport belt 828 is transported, being separated from the photosensitive drums of the image forming units 821, 822, and. 823, as the shift unit 831 rotates clockwise.

In the image forming unit 824, even when the shift unit 831 rotates as shown in FIG. 27, the transport belt 828 is not seperated from the surface of the photosensitive drum 824*c* of the image forming unit 824 by means of the assistance roller 839. Accordingly, a monochrome image formed on the surface of the photocensitive drum 824*c* using black toner is reliably transferred onto the recording sheet S.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

a sheet feeding unit for feeding a recording sheet;

a transportation unit for transporting the recording sheet;

a plurality of image forming units which are set along a transportation path of the recording sheet and each include an image holding component;

a separating unit for moving the transportation unit away from at least one of the image holding components; and a guiding unit which shifts in accordance with movement of the transportation unit by the separating unit to guide the recording sheet fed by the sheet feeding unit to the transportation unit.

2. The image forming apparatus of claim 1, wherein the separating unit separates the transportation unit from all of the image holding components except for an image holding component set at a rearmost position of the transportation path of the recording sheet.

3. The image forming apparatus of claim 1 selectively operating in one of a full-color mode and a reduced-color mode, the full-color mode being where an image for a different color is formed on each image holding component and the formed images on the image holding components are successively transferred onto the recording sheet transported by the transportation unit, and the reduced-color mode being where an image is formed on at least one but not all of the image holding components and the formed images are transferred onto the recording sheet transported by the transportation unit, the separating unit moving the transportation unit away from at least one image holding component that does not have an image formed thereon when the image forming apparatus is operating in the reduced-color mode.

4. An image forming apparatus comprising:

a transport belt for transporting a recording sheet;

a plurality of image forming units which are set along a transportation path of the recording sheet and in which each image forming unit comprises an image holding component;

a plurality of members, each member being provided positionally opposite a different one of the image holding components, with the transport belt running between the plurality of members and the image holding components;

a member moving unit for moving a member selectively between a first position where the moved member presses the transport belt against the positionally opposite image holding component and a second position where the moved member is not in contact with the transport belt; and an extending unit which, when the moved member is in the second position, extends the transport belt to prevent the transport belt from touching the image holding component positionally opposite the moved member.

5. An image forming apparatus comprising:

a transport belt for transporting a recording sheet;

a plurality of image forming units which are set along a transportation path of the recording sheet and in which each image forming unit comprises an image holding component;

a plurality of members, each member being provided positionally opposite a different one of the image holding components, with the transport belt running between the plurality of members and the image holding components;

a member moving unit for moving a member selectively between a first position where the moved member presses the transport belt against the positionally opposite image holding component and a second position where the moved member is not in contact with the transport belt; and the image forming apparatus selectively operating in one of a full-color mode and a reduced-color mode, the full-color mode being where an image for a different color is formed on each image holding component and the formed images on the image holding components are successively transferred onto the recording sheet transported by a transportation unit, and the reduced-color mode being where an image is formed on at least one but not all of the image holding components and the formed images are transferred onto the recording sheet transported by the transportation unit, and wherein the member moving unit moves a member positionally opposite an image holding component that does not have an image formed thereon to the second position when the image forming apparatus is operating in the reduced-color mode.

6. An image forming apparatus, comprising:

a transport belt that revolves to transport a recording sheet;

a plurality of image forming units which are set along a transportation path of the recording sheet, each comprising an image holding component;

a transport belt moving unit for moving the transport belt between a first state and a second state by changing a form of a revolution of the transport belt, the first state being where the transport belt does not touch at least one of the image holding components and the second state being where the transport belt touches the image holding components not touched in the first state.

7. The image forming apparatus of claim 6, wherein the transport belt moving unit includes a roller provided on an inside of the transport belt.

8. The image forming apparatus of claim 7, wherein the transport belt moving unit includes a pushing unit for pushing the roller against the transport belt to move the transport belt to the second state.

9. The image forming apparatus of claim 7, further comprising an assistance roller provided on an inside of the transport belt the assistance roller determining a position of the transport belt in relation to an image holding component when the transport belt is in the first state.

10. The image forming apparatus of claim 6, selectively operating in one of a full-color mode and a reduced-color mode, the full-color mode being where an image for a different color is formed on each image holding component and the formed images on the image holding components are successively transferred onto the recording sheet transported by a transportation unit, and the reduced-color mode being where an image is formed on at least one but not all of the image holding components and the formed images are transferred onto the recording sheet transported by the transportation unit, and wherein the transport belt moving unit moves the transport belt into the second state so that the transport belt does not touch an image holding component that does not have an image formed thereon when the image forming apparatus is operating in the reduced-color mode.

11. The image forming apparatus of claim 10, further comprising a plurality of pressing members, each pressing member being provided positionally opposite a different one of the image holding components, with the transport belt running between the plurality of members and the image holding components, and each pressing member pressing the transport belt towards the positionally opposite image holding component.

12. The image forming apparatus of claim 11, further comprising a pressure releasing unit for releasing pressure of a pressing member provided positionally opposite an image holding component that does not have an image formed thereon when the image forming apparatus is operating in the reduced-color mode.

13. The image forming apparatus of claim 12, further comprising a running path maintaining unit for maintaining a running path of the transport belt in proximity to at least one image holding component that has an image formed thereon regardless of whether the image forming apparatus is operating in the reduced-color mode or in the full-color mode.

14. The image forming apparatus of claim 13, wherein the running path maintaining unit is composed of two rollers with respective fixed axes, the rollers extending the transport belt in the proximity of each image holding component that has an image formed thereon.

15. An image forming apparatus comprising:

a transportation unit for transporting a recording sheet;

a plurality of image forming units which are set along a transportation path of the recording sheet, each of which comprises an image holding component;

a plurality of cleaning components, each contacting with an image holding component and cleaning a surface of the image holding component;

a first unit for sequentially transferring an image respectively formed on all the image holding components onto the transported recording sheet;

a second unit for transferring an image formed on an image holding component onto the transported recording sheet;

a disengaging unit for disengaging a cleaning component of an image holding component which is not used for an image formation performed by the second unit; and a prohibiting unit for prohibiting disengagements of the cleaning components from the image holding components when the image formation is performed by the first unit.

16. An image forming apparatus which selectively operates in either a full-color mode or a reduced-color mode, the full-color mode being where each different color of an image is formed on each image holding component and the formed images on the image holding components are successively transferred onto a recording sheet transported by a transportation unit, and the reduced-color mode being where an image is formed on at least one but not all of the image holding components and the formed images are transferred onto the recording sheet transported by the transportation unit, the image forming apparatus comprising:

a separating unit for separating the transportation unit from at least one image holding component that does not have an image formed thereon when the image forming apparatus is operating in the reduced-color mode; and a maintaining unit for maintaining a transportation path of the recording sheet relative to each image holding component used for an image formation regardless of whether an image formation is performed in the full-color mode or the reduced-color mode.

17. The image forming apparatus of claim 16, wherein the transportation unit is a loop-shaped belt.

18. The image forming apparatus of claim 17, wherein the maintaining unit is composed of two rollers which extend part of the loop-shaped belt in a vicinity of the image holding component used for the image formation, with axes of the rollers being fixed.

19. An image forming apparatus which is capable of switching between a full-color mode and a monochrome mode, the image forming apparatus comprising:

a black image forming unit, including an image holding component, for forming a black toner image on the image holding component;

a plurality of color image forming units, each including an image holding component;

a transport belt for transporting a recording sheet to have the recording sheet pass under all the image holding components;

a separating unit for separating the transport belt from the plurality of image holding components of the plurality of color image forming units when an image formation is performed in the monochrome mode; and a running path maintaining unit for maintaining a running path of the transport belt in proximity to the image holding component of the black image forming unit, regardless of whether the image formation is performed in the monochrome mode or in the full-color mode.

20. The image forming apparatus of claim 19, wherein all the image holding components are set in a roughly straight line.

21. The image forming apparatus of claim 19, wherein the transport belt is extended by a plurality of rollers, and wherein the running path maintaining unit is composed of two rollers out of the plurality of rollers which extend part of the transport belt in the vicinity of the image holding component of the black image forming unit, with axes of the two rollers being fixed.

22. The image forming apparatus of claim 19, wherein the transport belt is extended by the plurality of rollers, and wherein the separating unit includes a roller shifting unit for shifting at least one of the plurality of rollers.

23. The image forming apparatus of claim 19, further comprising:

a sheet feeding unit for feeding a recording sheet; and a guiding unit which shifts in accordance with movement of the transport belt by the separating unit to guide the recording sheet fed by the sheet feeding unit to the transport belt.

24. The image forming apparatus of claim 19, wherein the transport belt is extended, being separated from the plurality of image holding components of the plurality of color image forming units, and wherein the separating unit includes:

a plurality of members, each member being provided positionally opposite a different one of the image holding components, with the transport belt running between the plurality of members and the image holding components; and a member moving unit for switching, by moving the plurality of members, between a state where the transport belt is pressed against the image holding components of the plurality of the color image forming units by the plurality of members and a state where the plurality of members are separated from the transport belt.

25. An image forming apparatus comprising:

a transport belt for transporting a recording medium;

a plurality of image forming units which are set along a transportation path of the recording medium and in which each image forming unit comprises an image holding component;

a plurality of members, each member being provided positionally opposite a different one of the image holding components, with the transport belt running between the plurality of members and the image holding components;

a member moving unit for moving a member selectively between a first position where the moved member presses the transport belt against the positionally opposite image holding component and a second position where the moved member is not in contact with the transport belt, and an extending unit which, when the moved member is in the second position, extends the transport belt to prevent the transport belt from touching the image holding component positionally opposite the moved member.

26. An image forming apparatus comprising:

a transport belt for transporting a recording medium;

a plurality of image forming units which are set along a transportation path of the recording medium and in which each image forming unit comprises an image holding component;

a plurality of members, each member being provided positionally opposite a different one of the image holding components, with the transport belt running between the plurality of members and the image holding components;

a member moving unit for moving a member selectively between a first position where the moved member presses the transport belt against the positionally opposite image holding component and a second position where the moved member is not in contact with the transport belt; and the image forming apparatus selectively operating in one of a full-color mode and a reduced-color mode, the full-color mode being where an image for a different color is formed on each image holding component and the formed images on the image holding components are transferred onto the recording medium, and the reduced-color mode being where an image is formed on at least one but not all of the image holding components and the formed images are transferred onto the recording medium, and wherein the member moving unit moves a member positionally opposite an image holding component that does not have an image formed thereon to the second position when the image forming apparatus is operating in the reduced-color mode.

27. An image forming apparatus, comprising:

a transport belt that revolves to transport a recording medium;

a plurality of image forming units which are set along a transportation path of the recording medium and each comprising an image holding component, the image holding component forming;

a transport belt moving unit provided inside of the path of travel of the transport belt for moving the transport belt between a first state and a second state by changing a form of a revolution of the transport belt, the first state being where the transport belt does not touch at least one of the image holding component and the second state being where the transport belt touches the image holding components not touched in the first state; and an image being formed on at least one image holding component and the formed image on the at least one image holding components is transferred onto the recording medium.

* * * * *